US011749515B2

(12) United States Patent
Ryan et al.

(10) Patent No.: US 11,749,515 B2
(45) Date of Patent: Sep. 5, 2023

(54) TAPERED MAGNETIC ION TRANSPORT TUNNEL FOR PARTICLE COLLECTION

(71) Applicant: Northrop Grumman Systems Corporation, Falls Church, VA (US)

(72) Inventors: Vivian W. Ryan, Severn, MD (US); Sameh S. Wanis, Washington, DC (US); Carl B. Freidhoff, New Freedom, PA (US); Clinton Ung, Ellicott City, MD (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 325 days.

(21) Appl. No.: 17/088,911

(22) Filed: Nov. 4, 2020

(65) Prior Publication Data

US 2021/0050204 A1 Feb. 18, 2021

Related U.S. Application Data

(62) Division of application No. 16/190,651, filed on Nov. 14, 2018, now abandoned.

(51) Int. Cl.
*H01J 49/06* (2006.01)
*H01J 49/28* (2006.01)

(52) U.S. Cl.
CPC ..... *H01J 49/066* (2013.01); *H01J 49/063* (2013.01); *H01J 49/284* (2013.01)

(58) Field of Classification Search
CPC ..... H01J 49/065; H01J 49/066
See application file for complete search history.

(56) References Cited

U.S. PATENT DOCUMENTS

| | | | | |
|---|---|---|---|---|
| 3,787,790 | A | 1/1974 | Hull et al. | |
| 4,535,235 | A | 8/1985 | McIver, Jr. | |
| 5,063,294 | A | 11/1991 | Kawata et al. | |
| 5,386,115 | A | 1/1995 | Freidhoff et al. | |
| 5,492,867 | A | 2/1996 | Kotvas et al. | |
| 5,530,355 | A * | 6/1996 | Doty | G01R 33/385 324/318 |
| 5,536,939 | A | 7/1996 | Freidhoff et al. | |
| 5,723,862 | A | 3/1998 | Forman | |
| 5,747,815 | A | 5/1998 | Young et al. | |
| 6,107,628 | A | 8/2000 | Smith et al. | |
| 6,583,426 | B1 | 6/2003 | Kawanami et al. | |
| 6,727,495 | B2 | 4/2004 | Li | |
| 7,057,170 | B2 | 6/2006 | Freidhoff | |
| 7,402,799 | B2 | 7/2008 | Freidhoff | |
| 7,459,693 | B2 | 12/2008 | Park et al. | |

(Continued)

OTHER PUBLICATIONS

Deflector: Spatial Separation, downloaded from https://www.phys.ksu.edu/personal/sroland/Deflector.htm on Nov. 2, 2018 at 11:25:37 AM, 1 page.

(Continued)

*Primary Examiner* — Sean M Luck
(74) *Attorney, Agent, or Firm* — Dority & Manning, P.A.

(57) ABSTRACT

An apparatus for particle collection is provided. The apparatus includes a magnetic element configured to generate a tapered magnetic ion transport tunnel that collects particles from a local environment, a detector configured to perform one or more measurements of the collected particles, and ion optics configured to transport the collected particles to the detector.

6 Claims, 31 Drawing Sheets

(56) References Cited

U.S. PATENT DOCUMENTS

| | | | | |
|---|---|---|---|---|
| 7,767,959 | B1 | 8/2010 | Freidhoff | |
| 7,928,363 | B2 | 4/2011 | Bateman | |
| 8,154,290 | B2 * | 4/2012 | Tanaka | H01F 7/202 324/318 |
| 8,324,565 | B2 | 12/2012 | Mordehai et al. | |
| 8,481,928 | B2 | 7/2013 | Franzen | |
| 8,946,625 | B2 | 2/2015 | Nikolaev et al. | |
| 9,721,777 | B1 | 8/2017 | Muntean | |
| 2003/0193031 | A1 * | 10/2003 | Sathrum | H01J 37/3266 250/426 |
| 2004/0195503 | A1 | 10/2004 | Kim et al. | |
| 2005/0199805 | A1 | 9/2005 | Freidhoff | |
| 2005/0285597 | A1 * | 12/2005 | Maki | G01R 33/3875 324/318 |
| 2006/0169892 | A1 * | 8/2006 | Baba | H01J 49/005 250/291 |
| 2007/0012563 | A1 * | 1/2007 | Wi | H01J 37/32009 204/298.25 |
| 2010/0308218 | A1 | 12/2010 | Wang | |
| 2011/0012017 | A1 | 1/2011 | Nishiguchi | |
| 2011/0198516 | A1 | 8/2011 | Fan | |
| 2012/0085869 | A1 | 4/2012 | Lloyd | |
| 2013/0049755 | A1 * | 2/2013 | Hollis | G01R 33/385 324/322 |
| 2013/0175441 | A1 | 7/2013 | Zanon | |
| 2013/0187044 | A1 | 7/2013 | Ding | |
| 2015/0206731 | A1 | 7/2015 | Zhang | |
| 2015/0371839 | A1 | 12/2015 | Yasuno | |
| 2016/0181080 | A1 | 6/2016 | Williams | |
| 2016/0260594 | A1 | 9/2016 | Hendricks | |
| 2018/0005812 | A1 | 1/2018 | Mavanur | |

OTHER PUBLICATIONS

D.L. Carroll's Fortran Genetic Algorithm Driver, http://cuaerospace.com/carroll/ga/ReadMe, Apr. 19, 2004 12:08:17 PM, 7 pages.

David E. Goldberg, Genetic Algorithms in Search, Optimization & Machine Learning, Jan. 1989, 432 pages.

Kerry Cheung, et al., Chip-Scale Quadrupole Mass Filters for Portable Mass Spectrometry, Journal of Microelectromechanical Systems, Apr. 26, 2010, 15 pages.

Yiyuan Cheng et al., Simulation and Optimization of a Permanent Magnet for Small-sized MRI by Genetic Algorithm, Proceedings of the 2nd International Conference On Systems Engineering and Modeling (ICSEM-13), Published by Atlantis Press, Paris, France, 2013, 4 pages.

Garrett H.B., Chapter 7, The Charging of Spacecraft Surfaces, downloaded from http://cnofs.org/ on Nov. 2, 2018, 37 pages.

"LLL Magnetic Fusion Energy Program: An Overview," Energy & Technology Review, Lawrence Livermore National Laboratory, Jun. 1976, 30 pages.

N.H. Press et al., Numerical Recipes: The Art of Scientific Computing, Third Edition, Cambridge Univ. Press, 2007, 1262 pages.

W.H. Press et al., Numerical Recipes: The Art of Scientific Computing, Third Edition, Cambridge Univ. Press, 2007, 1262 pages.

* cited by examiner

600

TAPERED MAGNETIC ION TRANSPORT TUNNEL FOR PARTICLE COLLECTION

CROSS-REFERENCE TO PRIORITY APPLICATIONS

This application is a divisional of U.S. application Ser. No. 16/190,651, filed on Nov. 14, 2018, entitled, "Tapered Magnetic Ion Transport Tunnel For Particle Collection," the contents of which are hereby incorporated by reference in their entirety.

FIELD OF INVENTION

The present invention relates to techniques for collecting charged particles in space.

BACKGROUND

Sensing ionic species from solar wind, solar mass ejection and other sources in space is becoming more important for a number of reasons. For example, mass spectrometers have been deployed on various space craft to determine the neutral species in the region above the atmosphere of planets and the moons of large planets. Mass spectroscopy allows for a definitive and quantitative measurement of a nearby chemical species and thus allows for attribution (and/or other applications such as intelligence) of a sample when an ejection of a thruster or outgassing occurs nearby. The ion energy is one of the primary properties in a mass spectrometer to help identify the chemical species through their mass to charge ratio. However, the natural ions in space have not been sampled chemically since the ion energies of the solar wind and other phenomena are at very high ion energies (1-3 keV).

Typical mass spectrometers used in the past operate at low ion energies (1-10 eV). In some solar mass ejections, all ions have the same velocity and therefore, different ion energies. For example, current mass spectrometers cannot directly measure particles produced by the sun during a solar event because those particles have such high charge/energy. Tapered-hole diameters of mass spectrometer aperture slits can limit the condensation of flux, but only at the expense of losing particles through collisions outside the hole and collisions with the walls that would neutralize ion charge. The inability to sense ionic species has hampered research on solar phenomena and has also made it difficult to determine the conditions faced by satellites and other space craft. As such, many characteristics of the distribution of space particles remain unknown, and space situational awareness is currently performed from ground-based sensors and optical sensors on-board satellites.

SUMMARY

In one form, an apparatus for particle collection in space is provided. The apparatus comprises: a first magnetic element configured to generate a tapered magnetic ion transport tunnel that collects particles from a local environment; a detector configured to perform one or more measurements of the collected particles; and ion optics configured to transport the collected particles to the detector. The ion optics may include two plates configured to generate an electric field that separates the collected particles from undesired particles based at least in part on respective charges and masses of the collected particles. The detector may include a mass spectrometer on a chip. The local environment may be a volume of space local to a satellite to which the apparatus is affixed.

In one example, the first magnetic element includes a multipole magnet. The multipole magnet may be disk-shaped and/or a quadrupole magnet. Furthermore, the multipole magnet may be one multipole magnet in a series of multipole magnets, and wherein each multipole magnet in the series of multipole magnets is azimuthally rotated relative to an adjacent disk-shaped multipole magnet. In a first example, each multipole magnet in the series of multipole magnets defines a hole through which the collected particles proceed, wherein a diameter of the hole is greater than a diameter of the hole of a subsequent multipole magnet in the series of multipole magnets. In a second example, each multipole magnet in the series of multipole magnets defines a hole through which the collected particles proceed, wherein the holes are of equal diameter.

In another example, the apparatus may include a conditioner between the first magnetic element and the ion optics. The conditioner may include a second magnetic element configured to generate a radially-increasing magnetic field to filter the collected particles from undesired particles. The second magnetic element may be a C-hairpin-shaped magnet. In another example embodiment, the C-hairpin-shaped magnet is nested in another C-hairpin-shaped magnet. In yet another example embodiment, the C-hairpin-shaped magnet is configured interlockingly with another C-hairpin-shaped magnet.

These and other example embodiments of the invention are described below with reference to the following drawing figures, in which like reference numerals in the various figures are utilized to designate like components.

DETAILED DESCRIPTION

Described herein is a tapered magnetic ion transport tunnel that may direct particles (e.g., ions) into an ion optic path of a detector. Briefly, the massless nature of the tapered magnetic ion transport tunnel may prevent the ions from colliding with any walls so that the ions are preserved and concentrated for analysis. Samples may be obtained from outside a satellite and concentrated with minimal or no wall collisions that would interfere with the ions (e.g., neutralize ion charge). This enables studying space weather and other ion producing phenomena by sampling ions over unprecedented volumes and ranges/diversities of energy, such as in space environments. In addition to mass spectrometry and ion energy collectors, the tapered magnetic transport tunnel may enable detection of non-ionized propellant types. Techniques described herein may also provide a pulse for ion and neutral detection. A second tapered magnetic transport tunnel may also be included outside the ion path for simultaneous detection.

Figure 1:
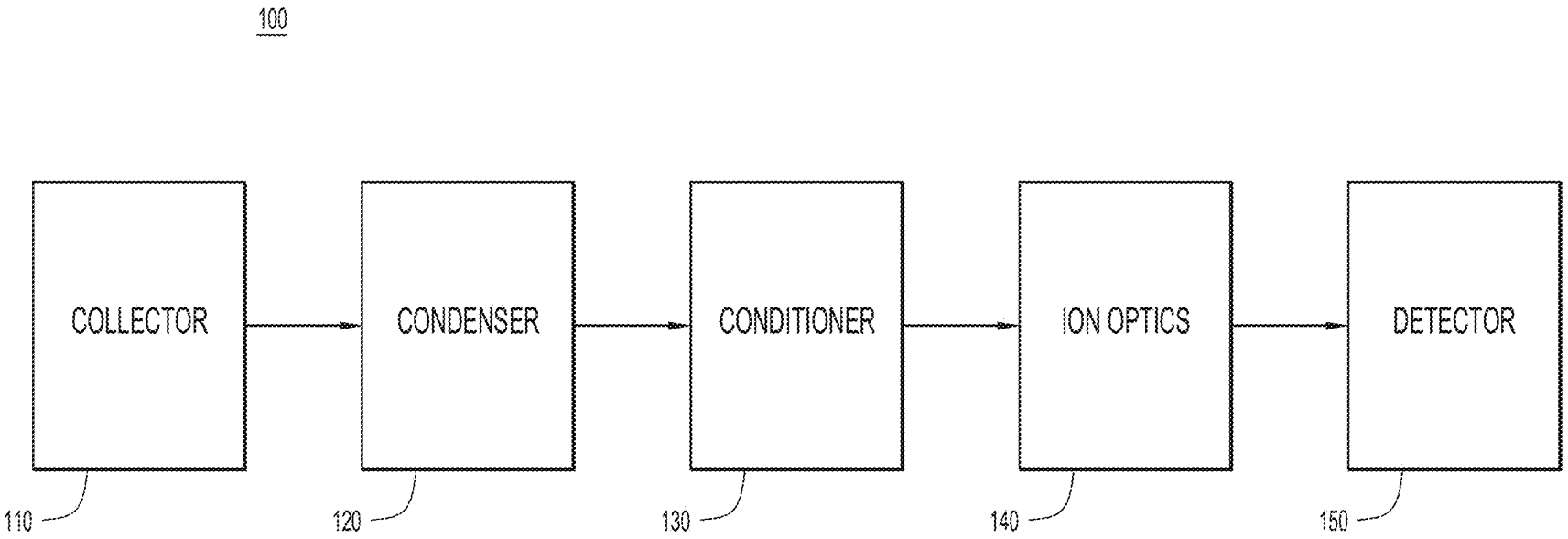
FIG. 1 is a functional block diagram of an apparatus configured to generate a tapered magnetic ion transport tunnel for particle collection, in an example embodiment.

With reference to FIG. 1, shown is a functional block diagram of an apparatus 100 configured for particle collection. Apparatus 100 includes a collector 110, condenser 120, conditioner 130, ion optics 140, and detector 150. Collector 110 may include a magnetic element configured to generate a tapered magnetic ion transport tunnel that collects particles from a local environment (e.g., a volume of space local to a satellite to which apparatus 100 is affixed). Condenser 120 may be a magnetic element configured to magnetically confine trajectories of ions collected by collector 110. In one example, the magnetic element of collector 110 and the magnetic element of condenser 120 may be the same magnetic element.

Conditioner 130 may be a magnetic filter for tuning particle flux matched to detector 150. Ion optics 140 may be configured to transport the collected particles to detector 150. Ion optics 140 may be an electric field ion optic transport configured to separate ion energies and eliminate fast neutrals. Detector 150 (e.g., a Mass Spectrometer on a Chip (MSOC)) may be configured to perform one or more measurements of the collected particles and/or provide a species readout. Detector 150 may include a micro-channel multiplier plate configured to provide detection final gain.

Apparatus 100 may further include a plate (e.g., housing) having an aperture configured to accept ions. Collector 110 and condenser 120 may generate a tapered magnetic ion transport tunnel upstream of ion optics 140 such that the tapered magnetic ion transport tunnel extends beyond the aperture. For instance, the tapered magnetic ion transport tunnel may extend into space and thereby admit into the aperture more particles than would otherwise be intercepted by the aperture with no such assistance from the tapered magnetic ion transport tunnel.

Conditioner 130 may tune the particle flux of ions collected by the tapered magnetic ion transport tunnel. Ion optics 140 may be configured to transport the ions from the aperture to detector 150. Collector 110, condenser 120, and conditioner 130 may be connected/attached/bolted to the front end of apparatus 100. It will be appreciated that collector 110, condenser 120, conditioner 130 may be operable independently from or synchronized with each other.

Figure 2A:
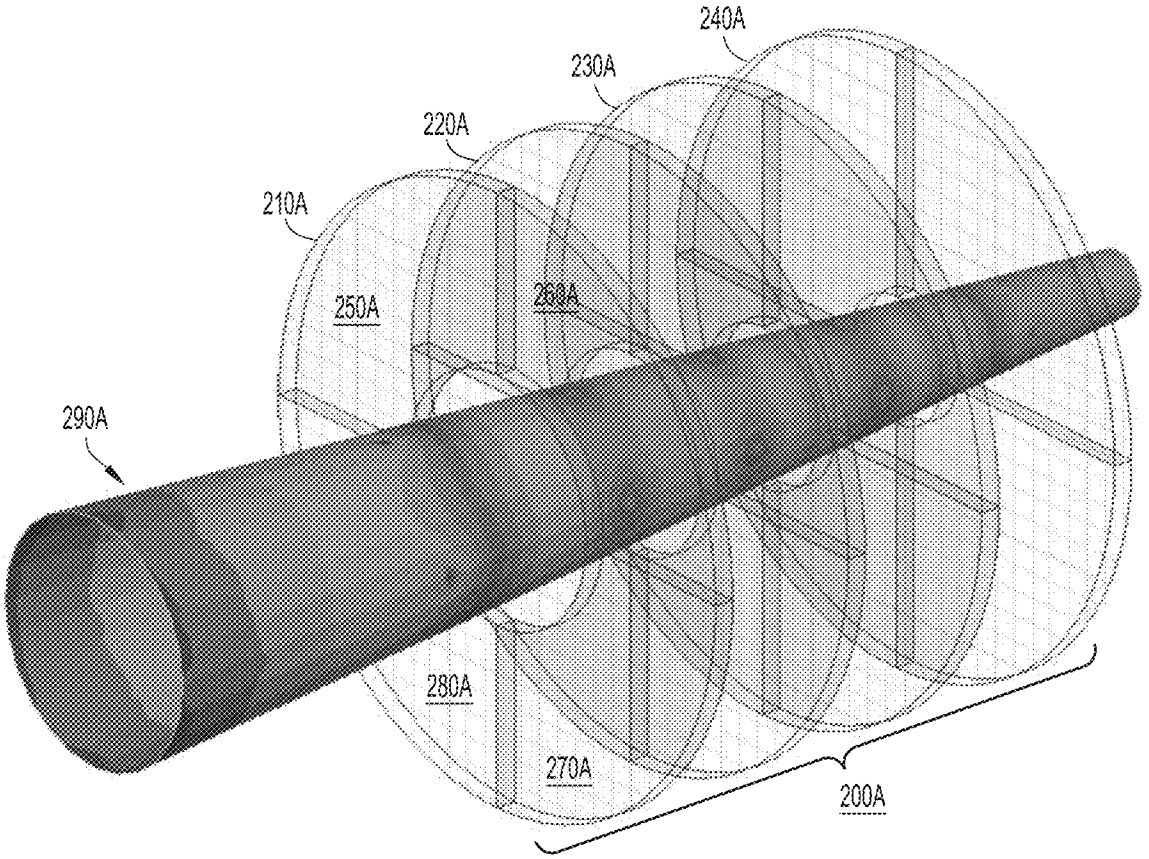
FIGS. 2A-2C are schematic diagrams illustrating a collector and condenser configured to generate the tapered magnetic ion transport tunnel of FIG. 1, in an example embodiment.

FIGS. 2A-2M relate to collector 110 and condenser 120. FIG. 2A illustrates an example instantiation of collector 110 and condenser 120 as a series 200A of disk-shaped multipole magnets 210A-240A. Each disk-shaped multipole magnet 210A-240A is a quadrupole magnet. For example, multipole magnet 210A includes four quadrants 250A-280A. Quadrants 250A and 270A are south, and quadrants 260A and 280A are north. Series 200A generates tapered magnetic ion transport tunnel 290A. Briefly, particles are collected at the wider end of tapered magnetic ion transport tunnel 290A and condensed through series 200A to the narrower end of tapered magnetic ion transport tunnel 290A.

Each disk-shaped multipole magnet 210A-240A is azimuthally rotated relative to ("crossed with") an adjacent disk-shaped multipole magnet. In the example of FIG. 2A, each disk-shaped multipole magnet 210A-240A is azimuthally rotated 90 degrees relative to an adjacent disk-shaped multipole magnet 210A-240A. For example, the quadrants in disk-shaped multipole magnet 220A that align with quadrants 250A and 270A are north, and the quadrants in disk-shaped multipole magnet 220A that align with quadrants 260A and 280A are south. Furthermore, each disk-shaped multipole magnet 210A-240A has an inner (hole) diameter that is greater than the subsequent disk-shaped multipole magnet in series 200A. For example, disk-shaped multipole magnet 210A has an inner diameter that is greater than that of disk-shaped multipole magnet 220A, disk-shaped multipole magnet 220A has an inner diameter that is greater than that of disk-shaped multipole magnet 230A, etc.

In one example, a genetic algorithm may be used to arrive at the appropriate magnetic arrangement while accounting for the independent magnetic fields of the magnetic ion transport tunnel and the MSOC. In this example, each disk-shaped multipole magnet 210A-240A has an outer diameter of 24 mm and a thickness of 0.81 mm, the distance/spacing between disk-shaped multipole magnets 210A-240A is 6.23 mm, and the inner diameters in series 200A decreases by a factor of 1.2 with every subsequent disk-shaped multipole magnet. However, it will be appreciated that multipole magnets of any suitable dimensions may be used (e.g., a thickness of 6.3 mm). Moreover, disk-shaped multipole magnets 210A-240A are made of AlNiCo5, although in general any suitable material may be used (e.g., AlNiCo5, Sm2Co17, NdFeB, SrFe12O19, etc.). It will be further appreciated that multipole magnets of any suitable shape (e.g., disk, gradient/cylindrically shaped magnets, etc.) and n-pole (e.g., quadrupole, sextupole, octupole, etc.) may be utilized. Disk-shaped multipole magnets 210A-240A are six-Gauss permanent magnets, although the optimal strength of the magnetic fields to concentrate higher energy ions may vary according to the particular application.

Any suitable structure may be used to secure disk-shaped multipole magnets 210A-240A, such as, for example, rigid supports including aluminum or titanium. The focusing beam for disk-shaped multipole magnets 210A-240A may be tuned by adjusting position along the beamline axis. Angle orientation errors and bore aperture radius errors may be adjusted with guiding pins and driving screws. Precision machining may eliminate the need for adjustable alignment.

Tapered magnetic ion transport tunnel 290A effectively serves as a noncontact funnel to channel/guide charged particles to detector 150, thereby increasing the sampling volume of apparatus 100. Tapered magnetic ion transport tunnel 290A may form a magnetic cone that concentrates ions by a factor of two. A physical cone as a material structure may not be required.

Figure 2B:
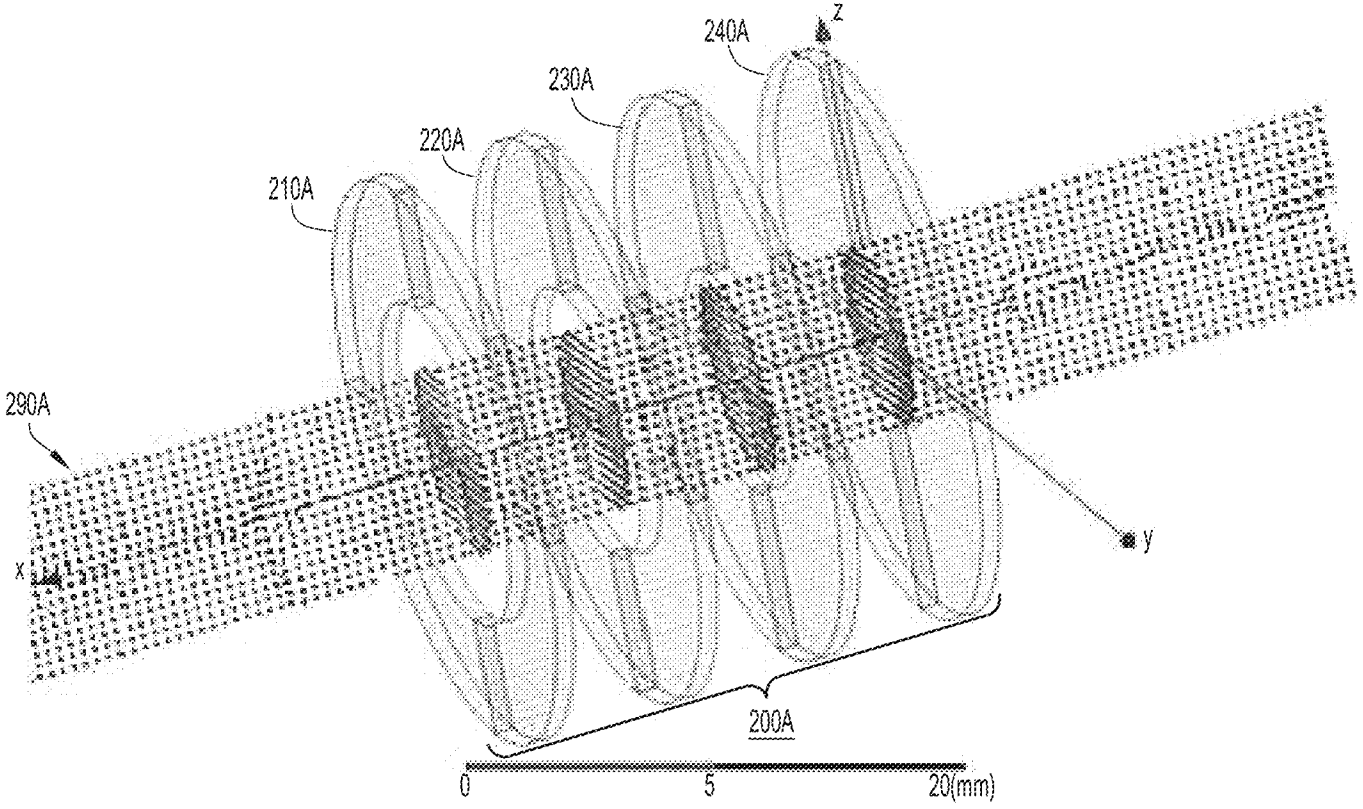

FIG. 2B illustrates series 200A and a vector field representing tapered magnetic ion transport tunnel 290A. As shown, the magnitude of tapered magnetic ion transport tunnel 290A grows weaker as it extends further from series 200A. The magnitude of tapered magnetic ion transport tunnel 290A reaches a local maximum in each of disk-shaped multipole magnets 210A-240A. The local maxima grow progressively stronger with every subsequent disk-shaped multipole magnet. For example, disk-shaped multipole magnet 210A, which has the largest inner diameter, has the weakest local maximum. Disk-shaped multipole magnet 240A, which has the smallest inner diameter, has the strongest local maximum.

Figure 2C:
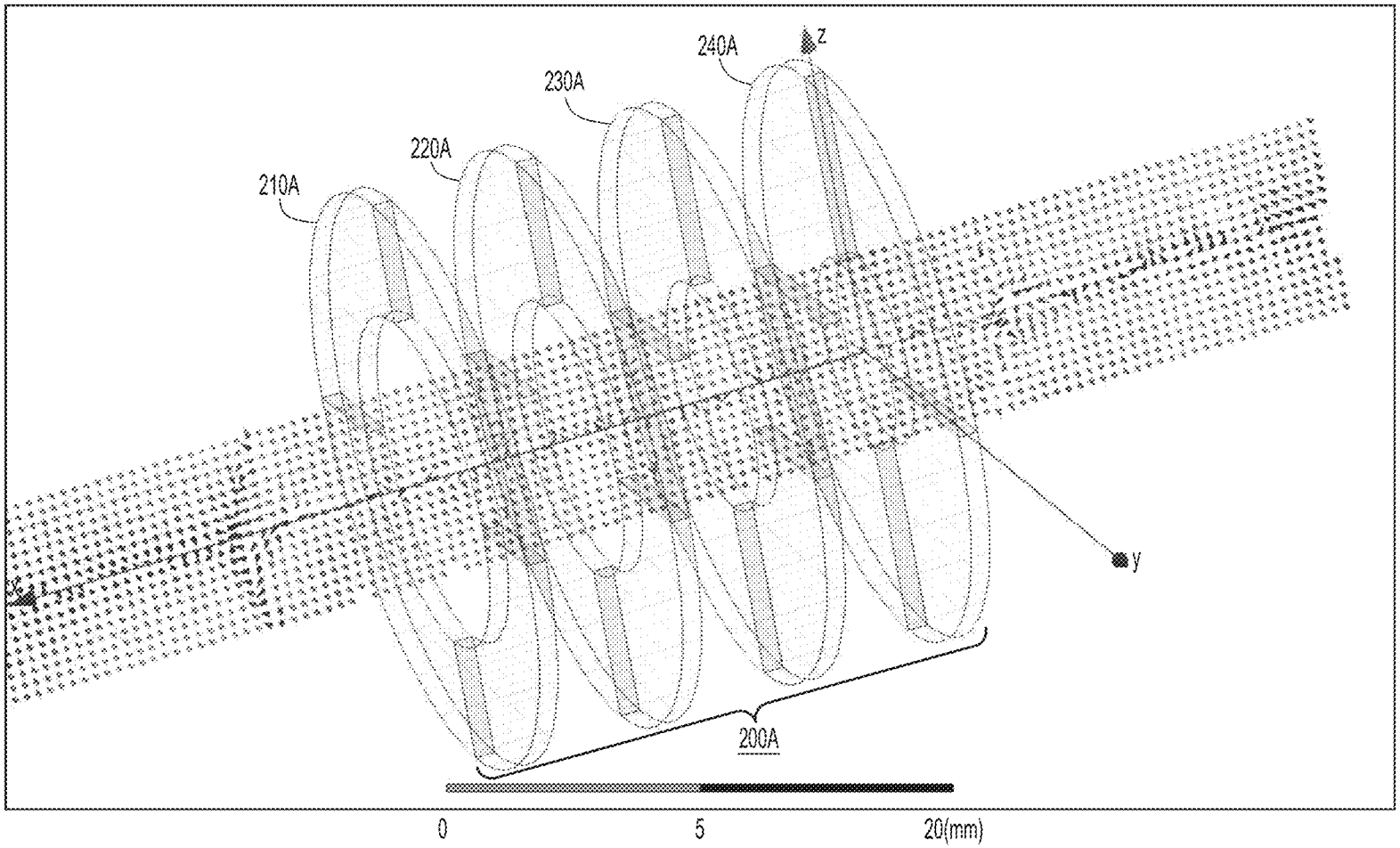

FIG. 2C illustrates series 200A and the vector field representing tapered magnetic ion transport tunnel 290A. Unlike FIG. 2B, FIG. 2C shows the vector field in a single plane (instead of also showing the local maxima of disk-shaped multipole magnets 210A-240A in a perpendicular plane).

Figure 2D:
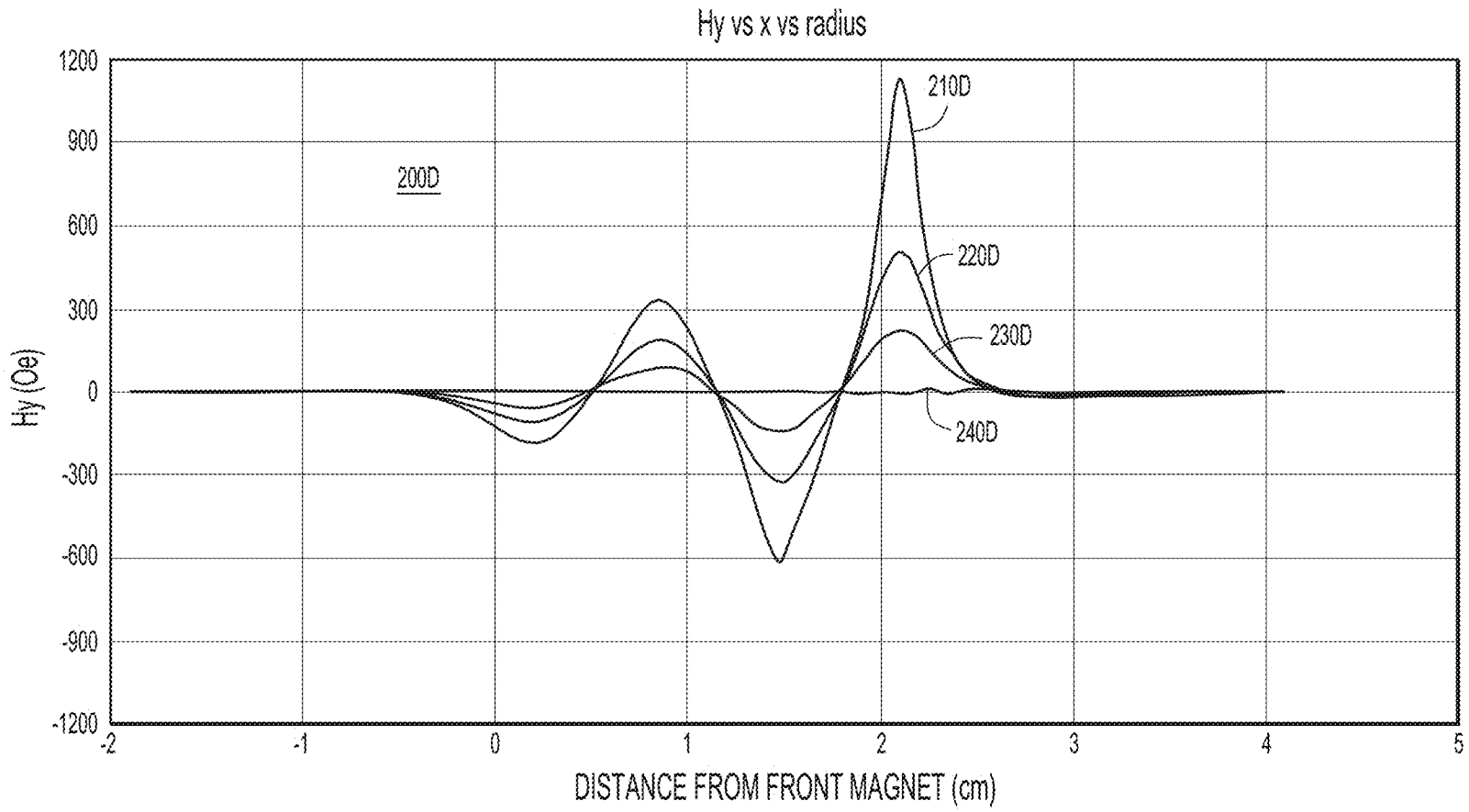
FIG. 2D is a plot illustrating the magnitude of the tapered magnetic ion transport tunnel of FIG. 1 generated by the collector and condenser of FIGS. 2A-2C, in an example embodiment.

FIG. 2D is a plot 200D illustrating the magnitude of tapered magnetic ion transport tunnel 290A as a function of distance from disk-shaped multipole magnet 210A. Plot 200D shows four different curves 210D-240D. Curves 210D-240D indicate the magnetic field strength along the y-axis (see FIGS. 2B and 2C) over a distance from the front magnet (measured along the x-axis) for disk-shaped multipole magnets 210A-240A.

Figure 2E:
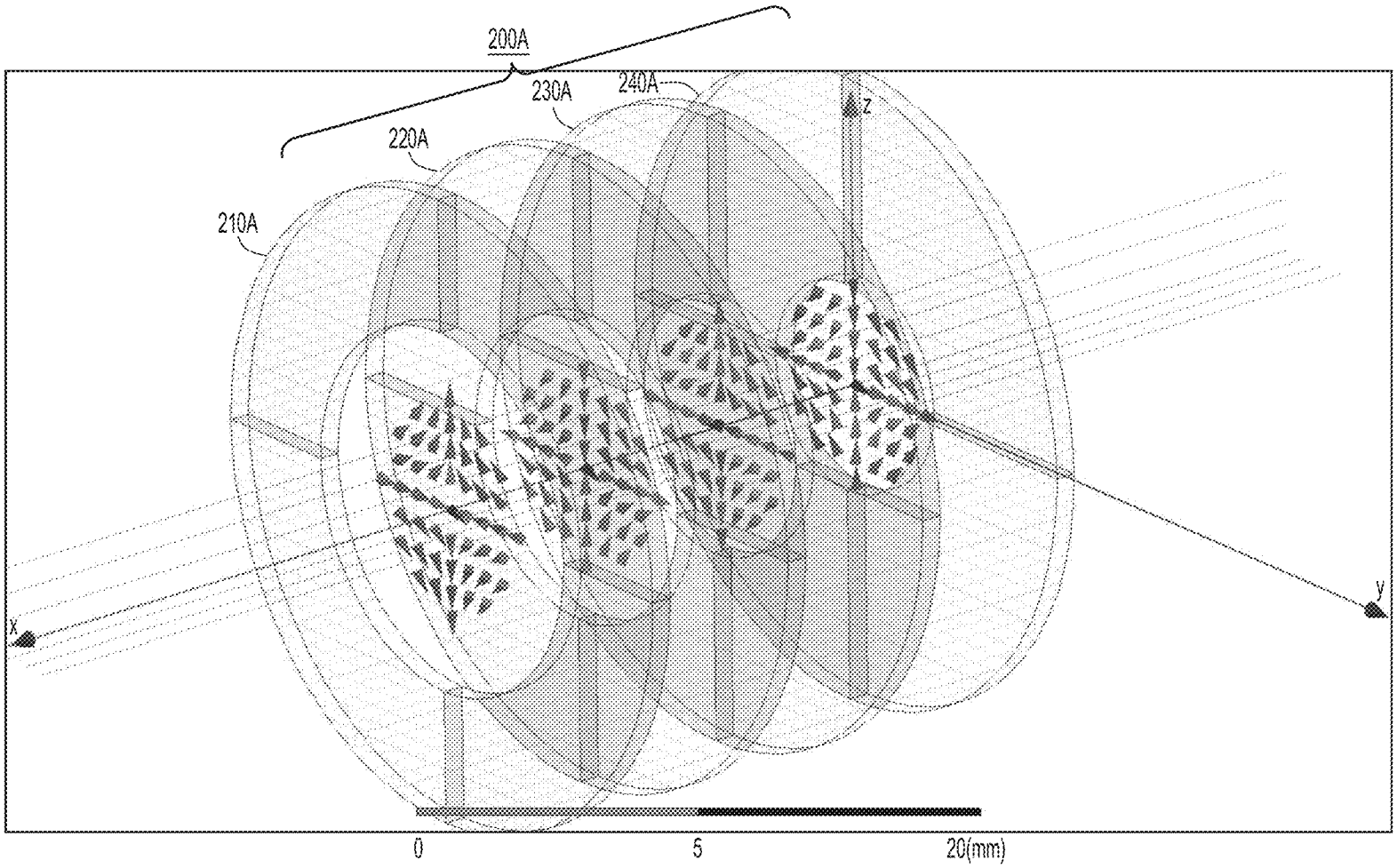
FIGS. 2E-2G are schematic diagrams illustrating the force due to the magnetic field generated by the collector and condenser of FIGS. 2A-2C on the trajectory of incoming particles of varying angles of incidence, in an example embodiment.
Figure 2F:
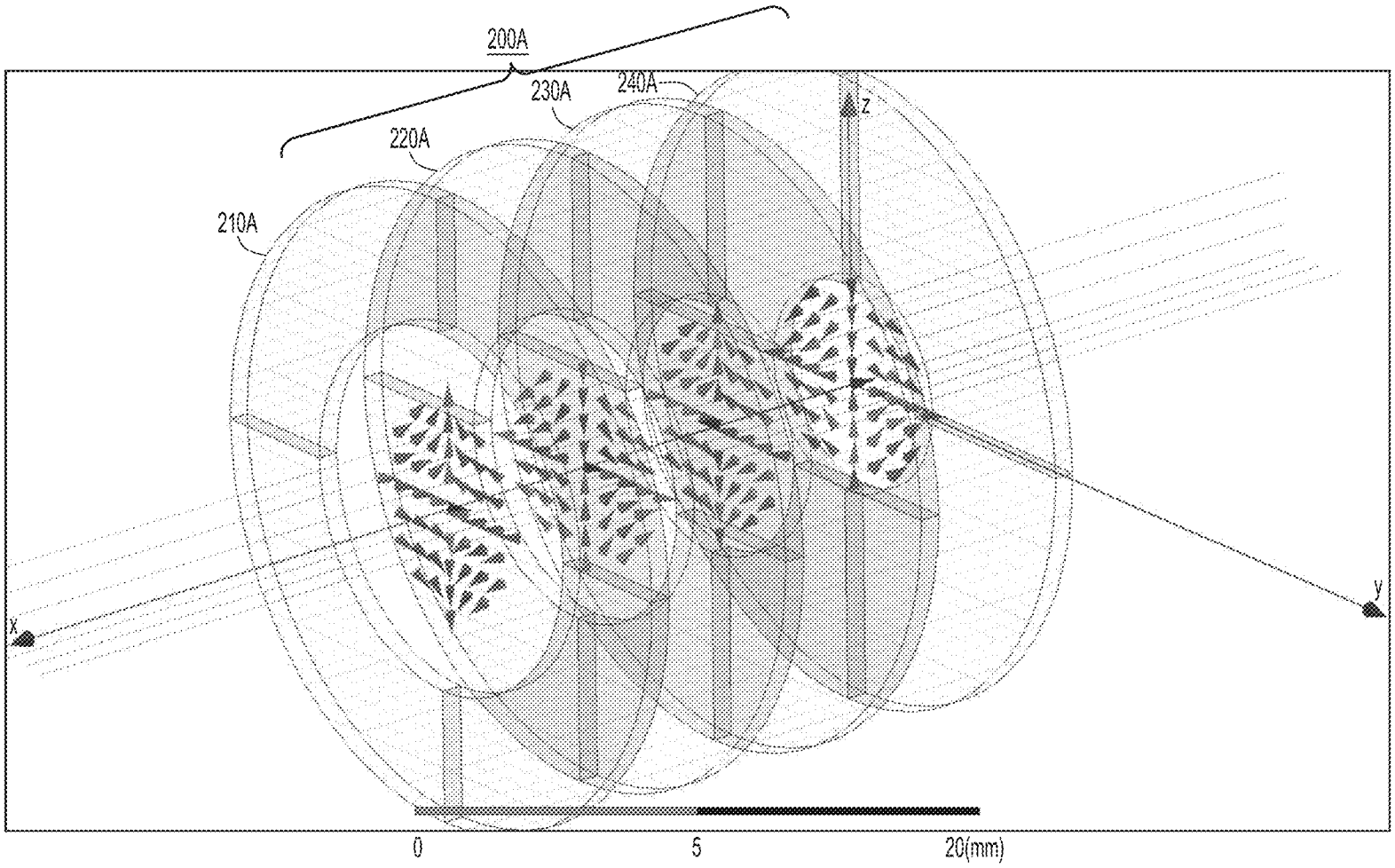
Figure 2G:
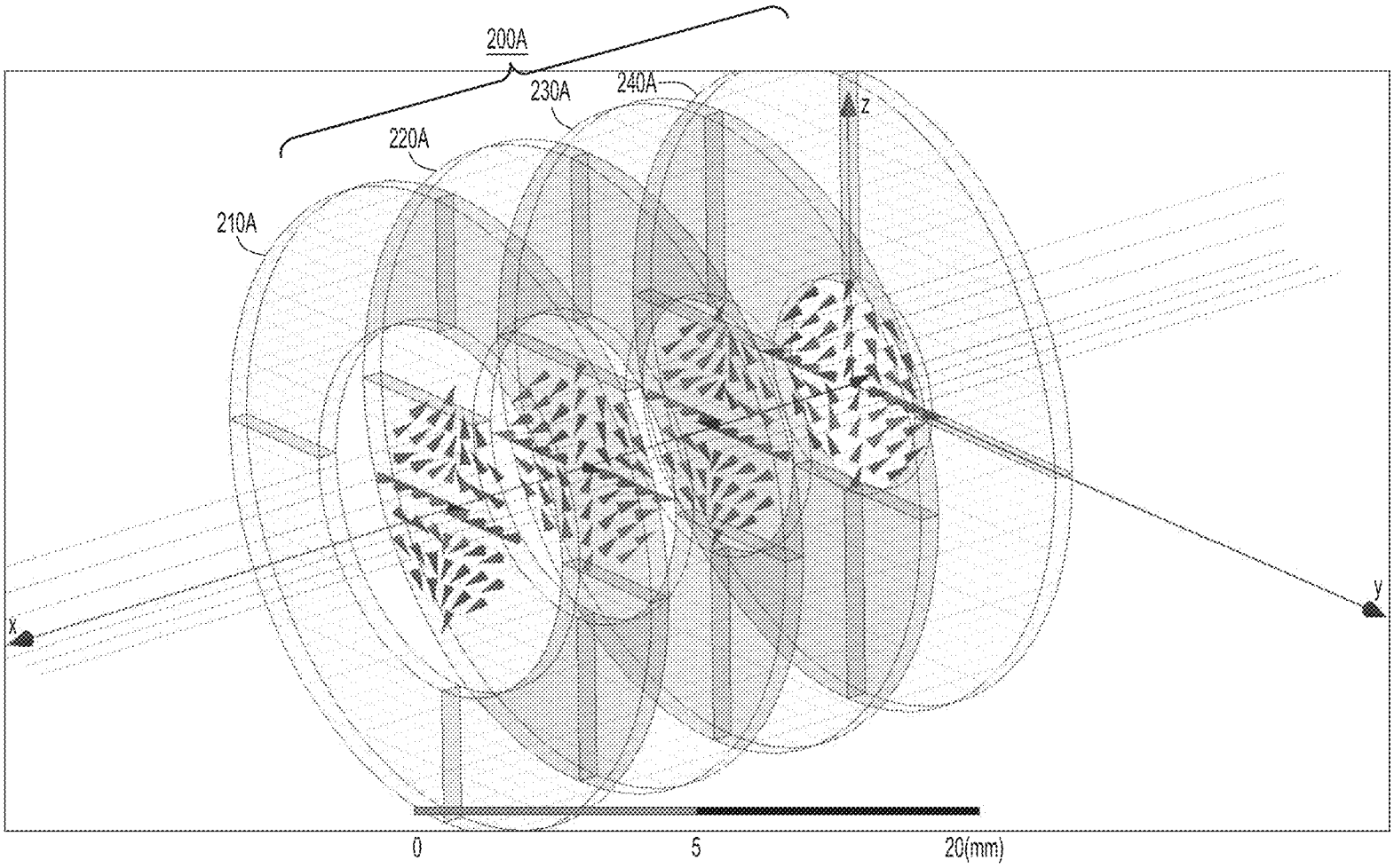

FIGS. 2E-2G illustrate series 200A where the velocity of an incoming particle is parallel to the x-axis, 30 degrees off the x-axis, and 30 degrees off the x-y and x-z planes, respectively. As shown, the effect of (force due to) the magnetic field on the trajectory of the incoming particle depends on the angle of incidence.

Figure 2H:
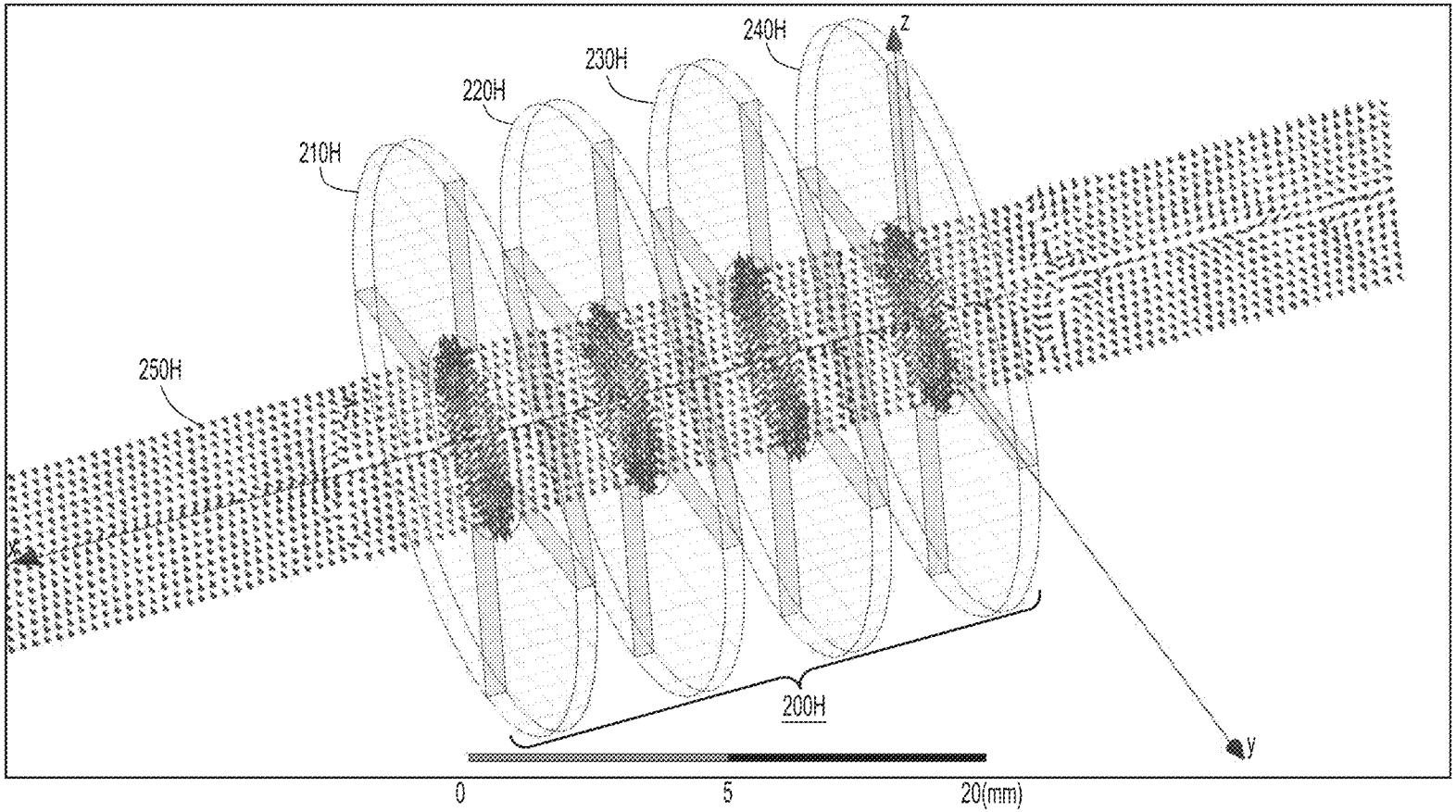
FIGS. 2H and 2I are schematic diagrams illustrating an alternative collector and condenser configured to generate the tapered magnetic ion transport tunnel of FIG. 1, in an example embodiment.

FIG. 2H illustrates an example instantiation of collector 110 and condenser 120 as a series 200H of disk-shaped multipole magnets 210H-240H. Series 200H generates tapered magnetic ion transport tunnel 250H, which is represented in FIG. 2H as a vector field. Series 200H may be similar to series 200A except that the inner diameters of disk-shaped multipole magnets 210H-240H are constant (e.g., 8 mm). The magnitude of tapered magnetic ion transport tunnel 250H reaches a local maximum in each of disk-shaped multipole magnets 210H-240H. The local maxima, like the inner diameters of disk-shaped multipole magnets 210H-240H, are constant (equal to each other).

Figure 2I:
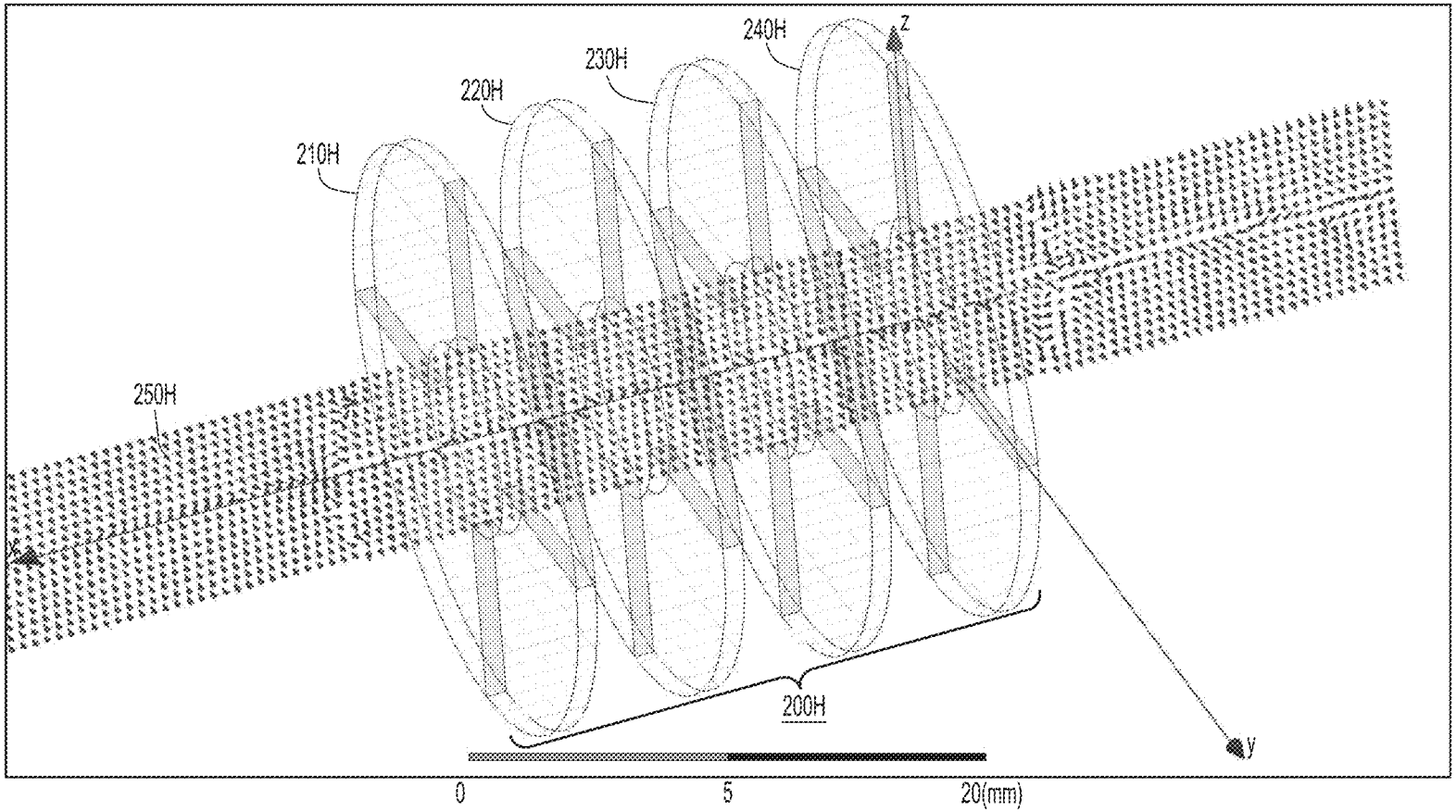

FIG. 2I illustrates series 200H and the vector field representing tapered magnetic ion transport tunnel 250H. Unlike FIG. 2H, FIG. 2I shows the vector field in a single plane (instead of also showing the local maxima of disk-shaped multipole magnets 210A-240A in a perpendicular plane).

Figure 2J:
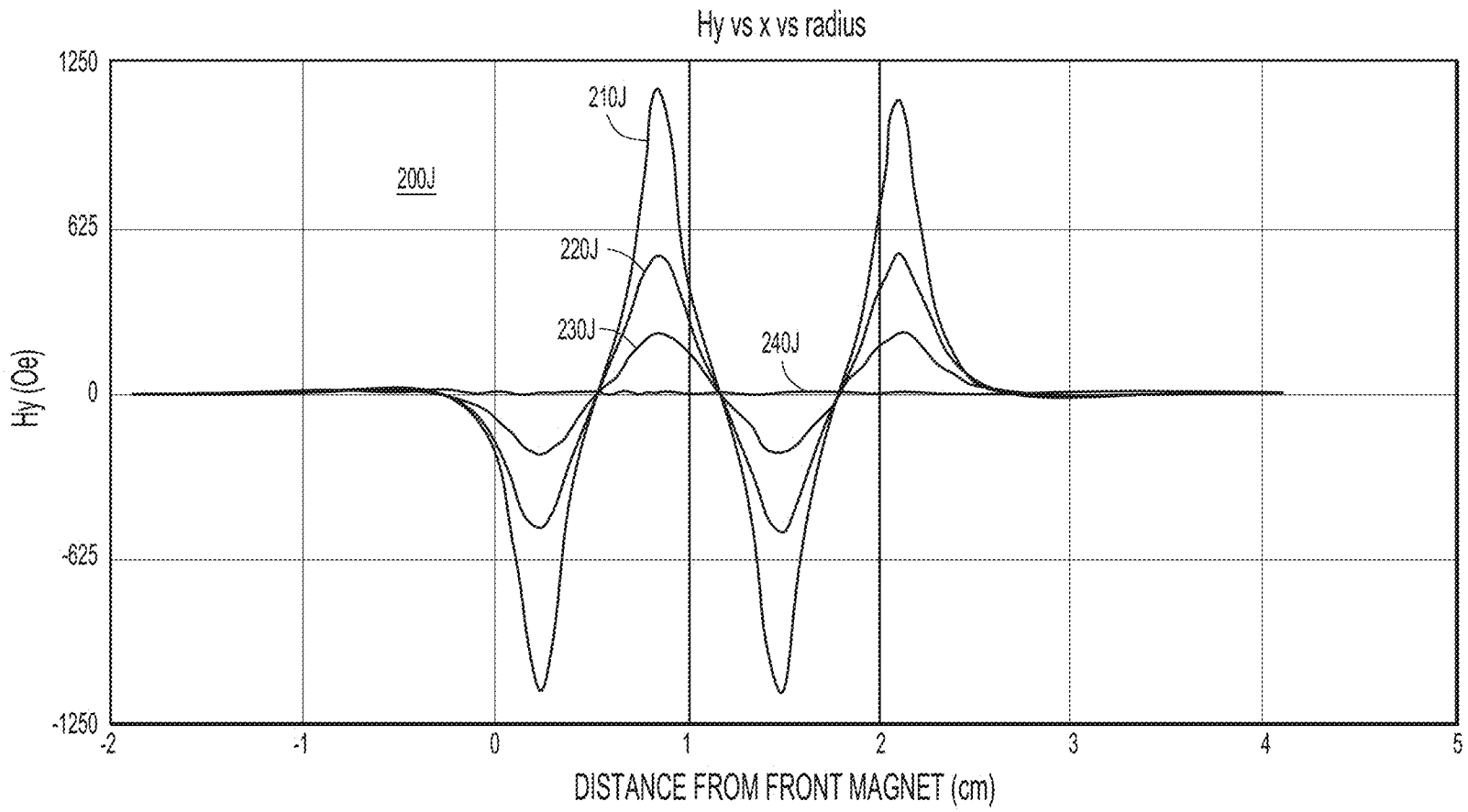
FIG. 2J is a plot illustrating the magnitude of the tapered magnetic ion transport tunnel of FIG. 1 generated by the collector and condenser of FIGS. 2H and 2I, in an example embodiment.

FIG. 2J is a plot 200J illustrating the magnitude of tapered magnetic ion transport tunnel 250H as a function of distance from disk-shaped multipole magnet 210H. Plot 200J shows four different curves 210J-240J. Curves 210J-240J indicate the magnetic field strength along the y-axis (see FIGS. 2H and 2I) over a distance from the front magnet (measured along the x-axis) for disk-shaped multipole magnets 210H-240H.

Figure 2K:
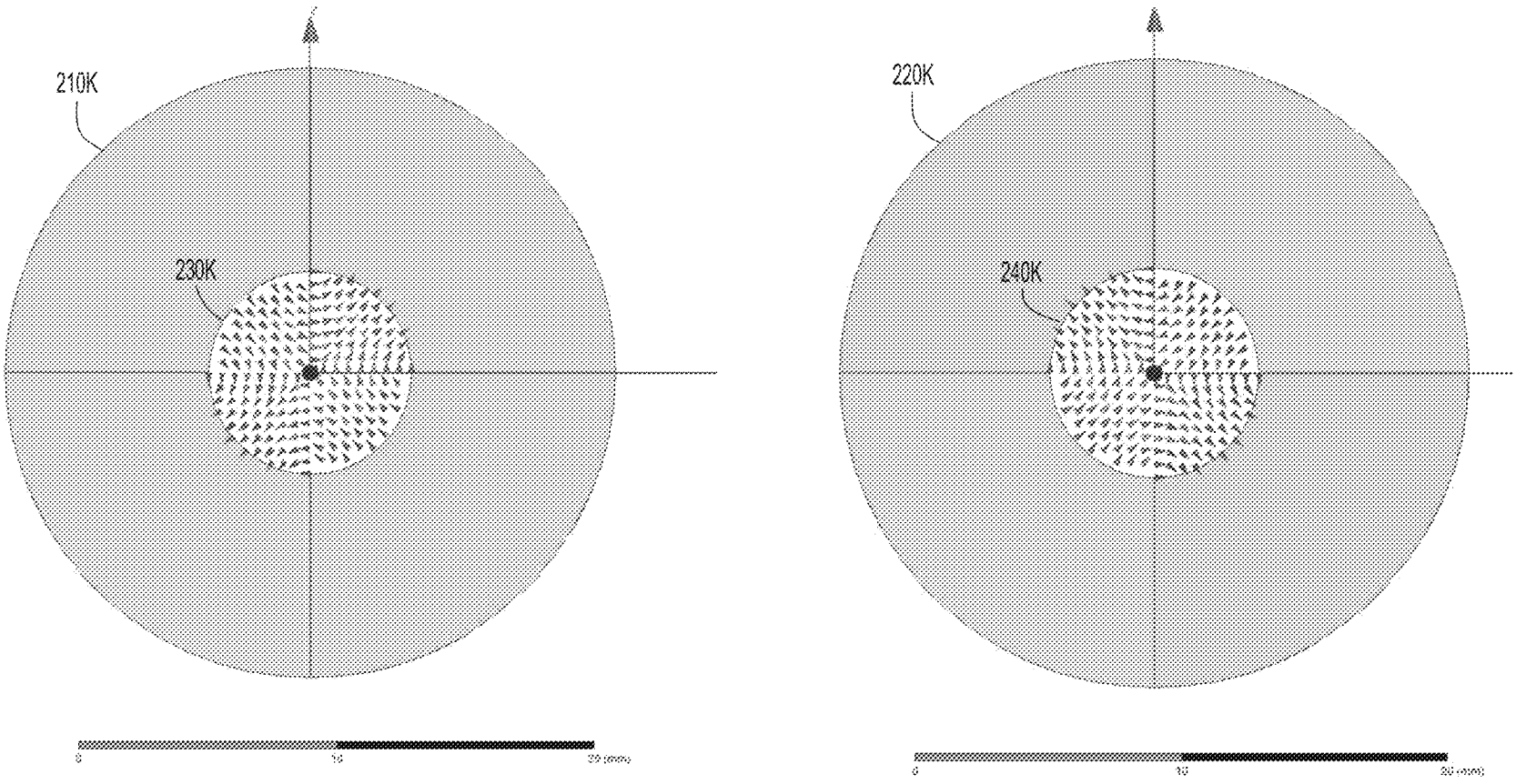
FIG. 2K is a cross-sectional view of magnetic elements of the collector and condenser of FIGS. 2H and 2I, in an example embodiment.

FIG. 2K is a cross-sectional view of an odd-numbered disk-shaped multipole magnet 210K (e.g., disk-shaped multipole magnet 210H) and an even-numbered disk-shaped multipole magnet 220K (e.g., disk-shaped multipole magnet 220H). FIG. 2K further illustrates respective cross-sections of the tapered magnetic ion transport tunnel in the holes 230K and 240K of disk-shaped multipole magnets 210K and 220K.

Figure 2L:
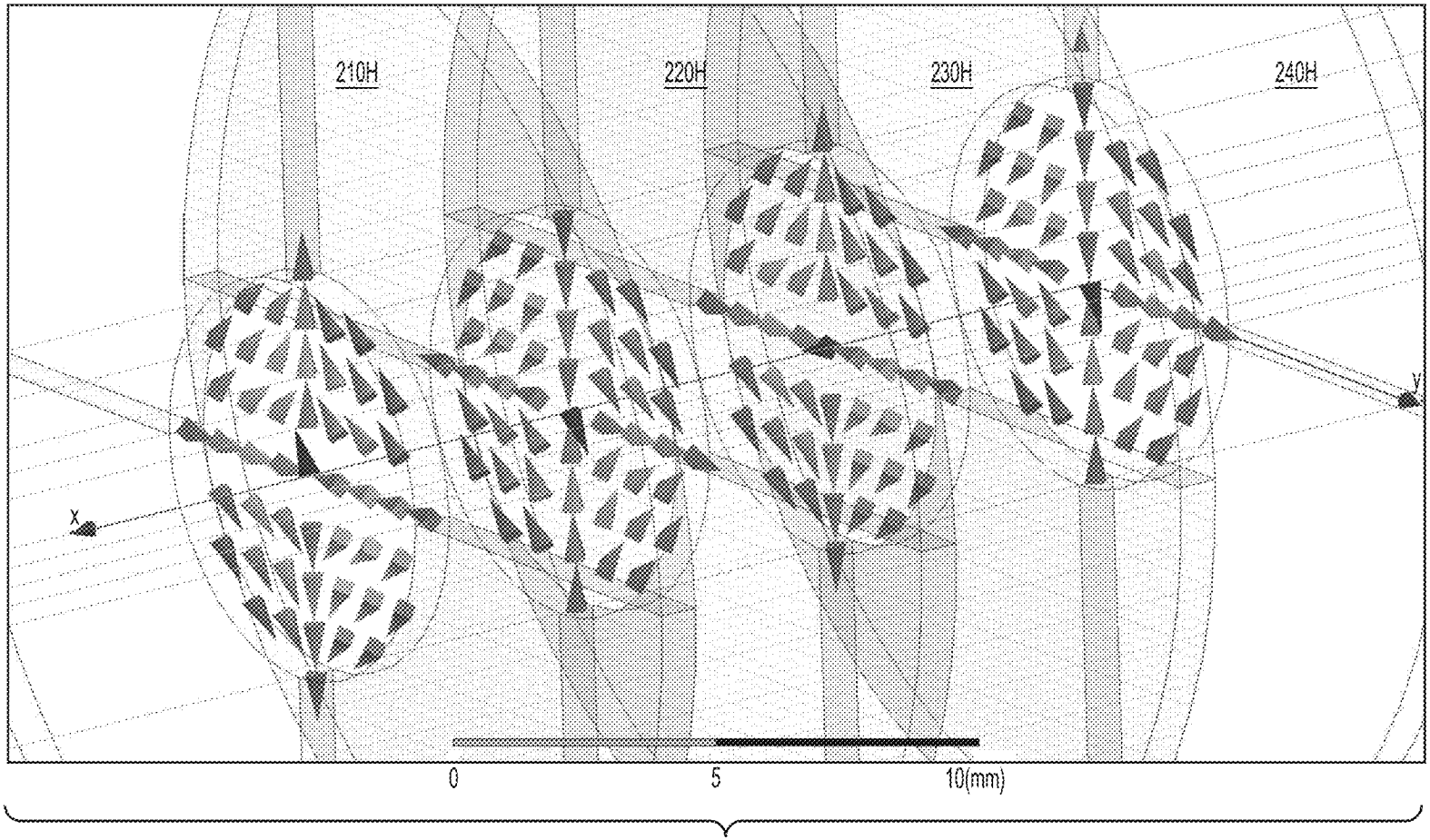
FIGS. 2L and 2M are perspective views of the collector and condenser of FIGS. 2H and 2I, in an example embodiment.
Figure 2M:
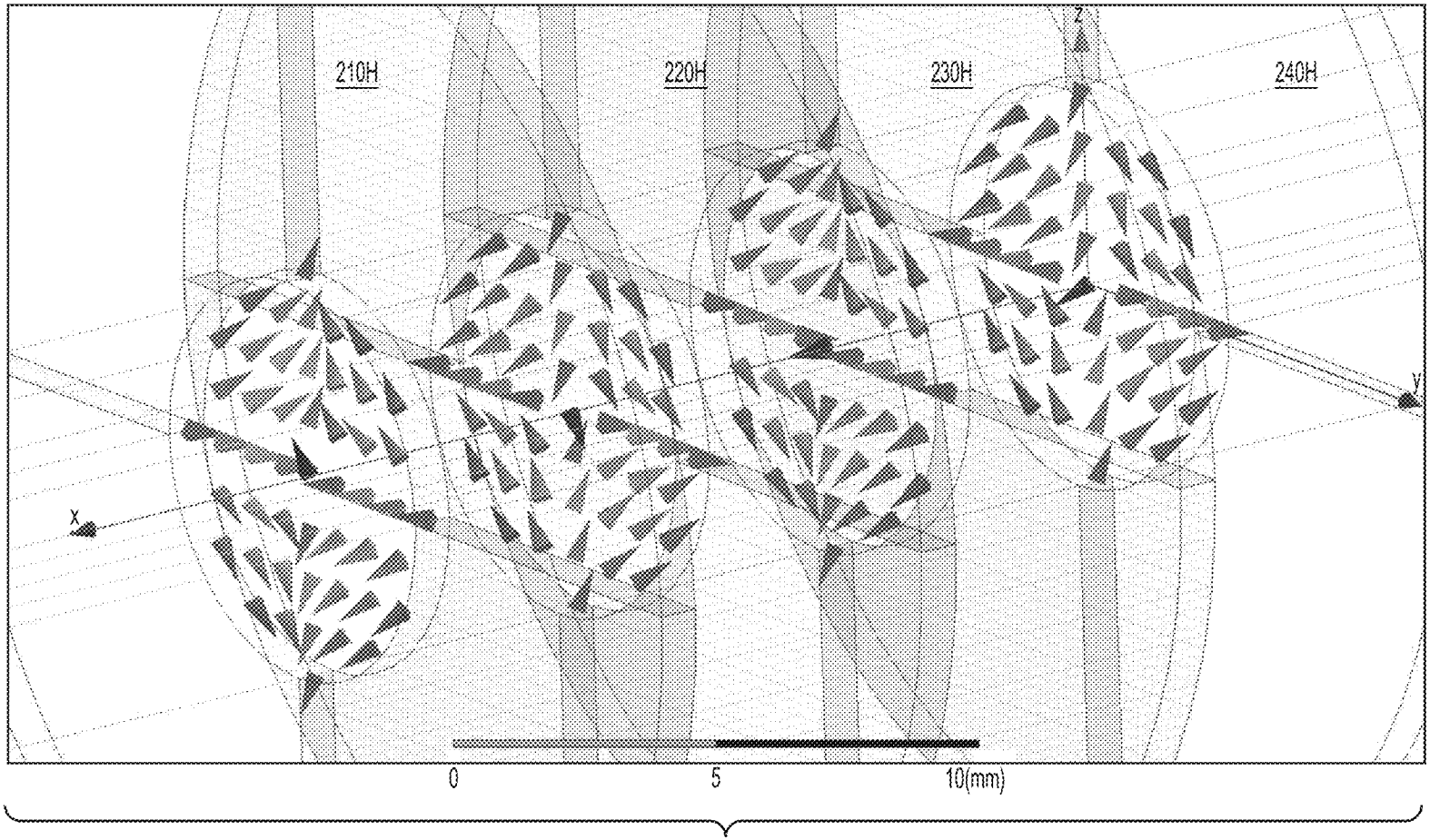

FIGS. 2L and 2M illustrate series 200H where the velocity of an incoming particle is parallel to the x-axis and 30 degrees off the x-y and x-z planes, respectively. As shown, the effect of (force due to) the magnetic field on the trajectory of the incoming particle depends on the angle of incidence.

Figure 3A:
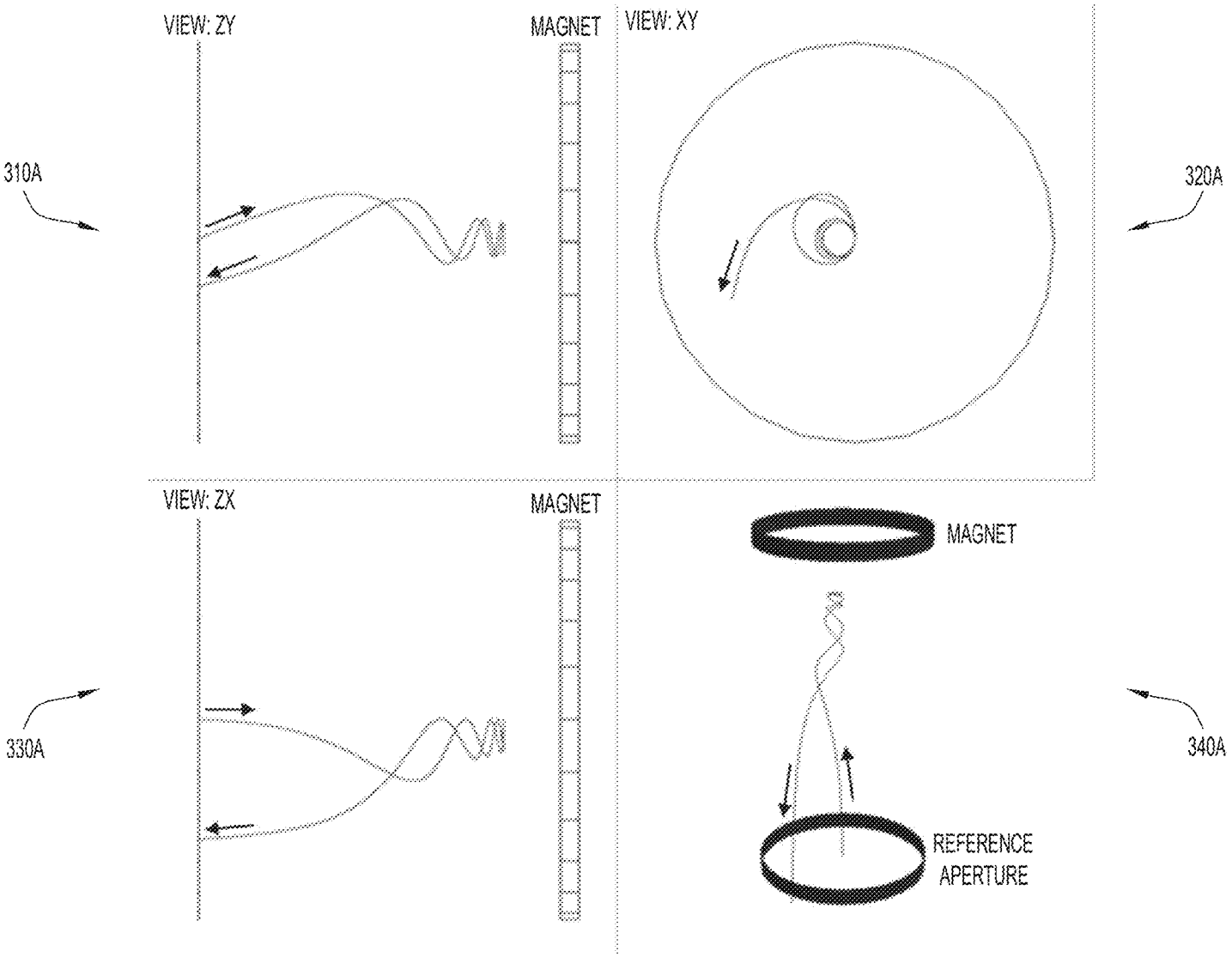
FIGS. 3A-3K are schematic diagrams illustrating example paths taken by particles collected and condensed by the apparatus of FIG. 1, in an example embodiment.

FIGS. 3A-3K are schematic diagrams (not necessarily to scale) illustrating example paths taken by particles collected by apparatus 100. With reference to FIG. 3A, shown are four views 310A-340A of an electron reflecting off a magnetic field generated near the center of a magnet. It will be appreciated that not all particles are necessarily mirrored back towards the reference aperture. The magnet configuration may be designed to transmit a desired spectrum of particles. Mirroring depends on off-axis distance at entry, magnetic field intensity/directionality, angle at entry, velocity, charge, and mass of the particle as that particle enters the vicinity of the magnetic field. Each of these factors may contribute to filtering metrics for particles.

Figure 3B:
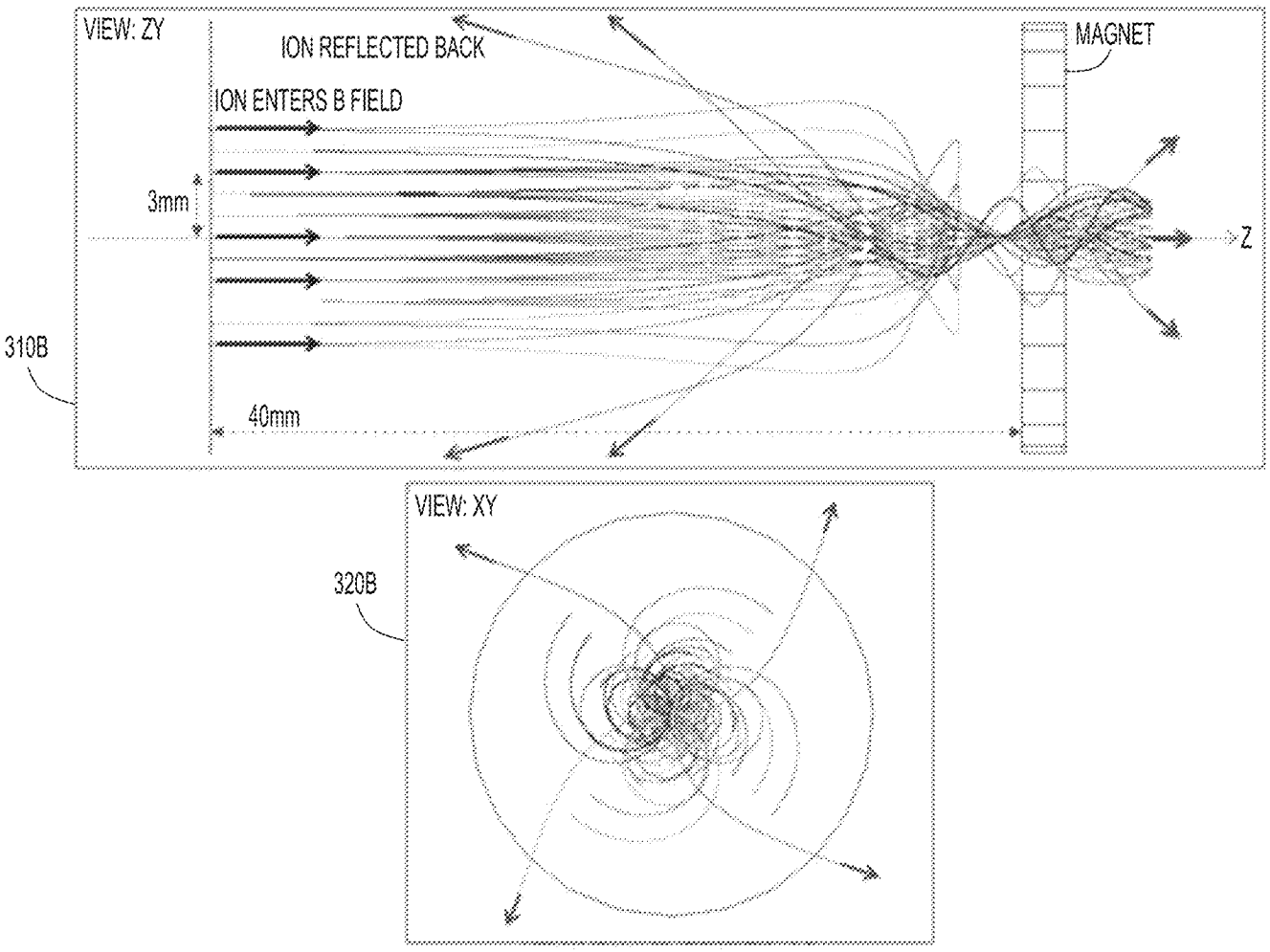

With reference to FIG. 3B, shown are two views 310B and 320B of a spatial ensemble of incident particles (e.g., a sheet of electrons). In this example, electrons incident at an off-Z-axis distance of greater than 4 mm are reflected back, electrons incident at an off-Z-axis distance of 4 mm hit the magnet pupil at a radius of approximately 3 mm, and electrons incident at an off-Z-axis distance of less than 4 mm pass through the magnet pupil at a radius of approximately 2 mm. The magnetic field along the Z-axis at the center of the magnet is 1.9E-3 Tesla. It is assumed that the magnetic field is not perturbed by charged particles.

Figure 3C:
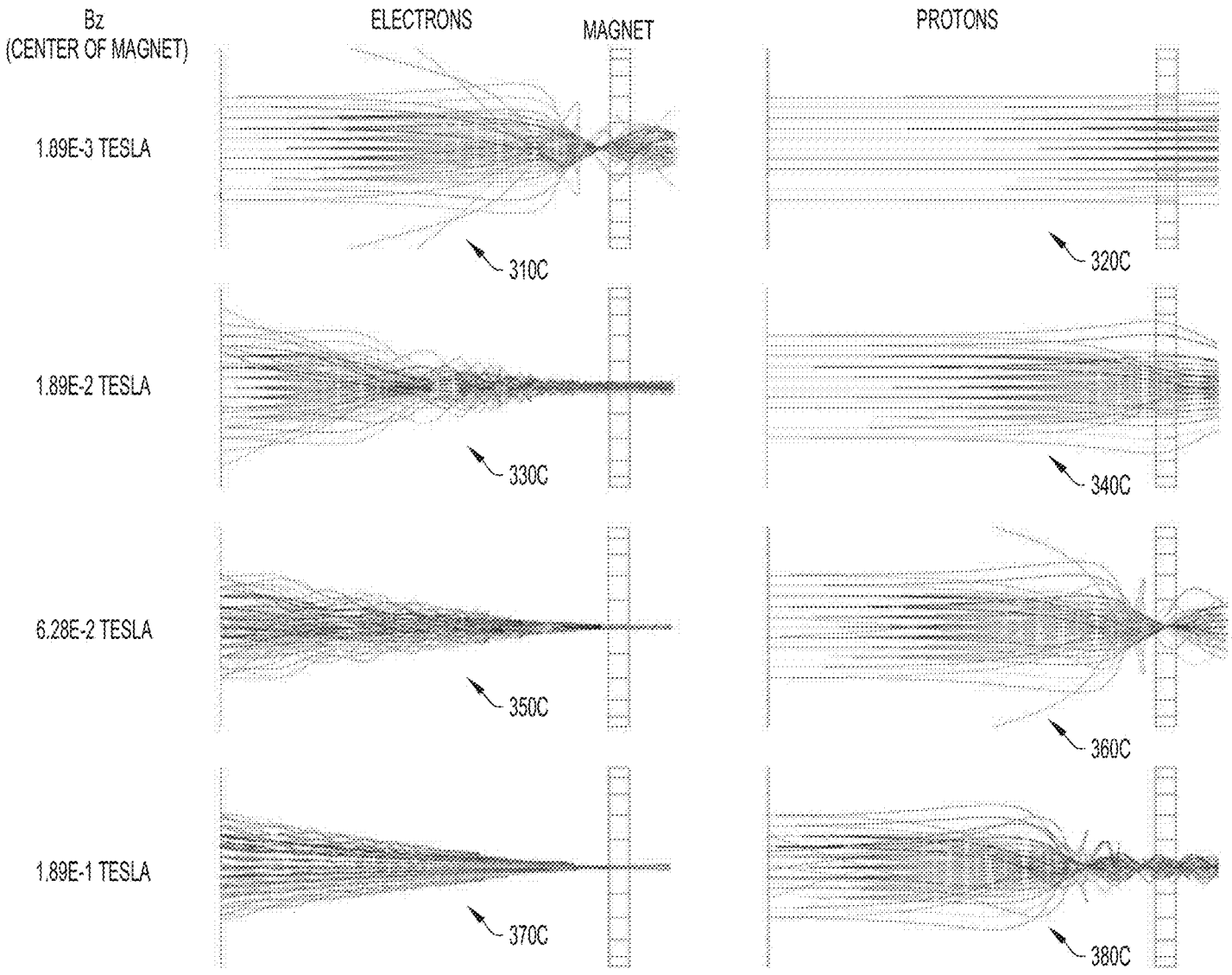

FIG. 3C illustrates schematic diagrams 310C-380C in which the magnetic field is adjusted/varied to selectively collect only portions of the mass-charge spectrum for ions that enter the magnetic field with a velocity that is parallel to the Z-axis. In schematic diagrams 310C and 320C, the magnetic field along the Z-axis at the center of the magnet is 1.89E-3 Tesla. In schematic diagrams 330C and 340C, the magnetic field along the Z-axis at the center of the magnet is 1.89E-2 Tesla. In schematic diagrams 350C and 360C, the magnetic field along the Z-axis at the center of the magnet is 6.28E-2 Tesla. In schematic diagrams 370C and 380C, the magnetic field along the Z-axis at the center of the magnet is 1.89E-1 Tesla. Schematic diagrams 310C, 330C, 350C, and 370C illustrates how electrons behave under these conditions. Schematic diagrams 320C, 340C, 360C, and 380C illustrate how protons behave under these conditions.

Figure 3D:
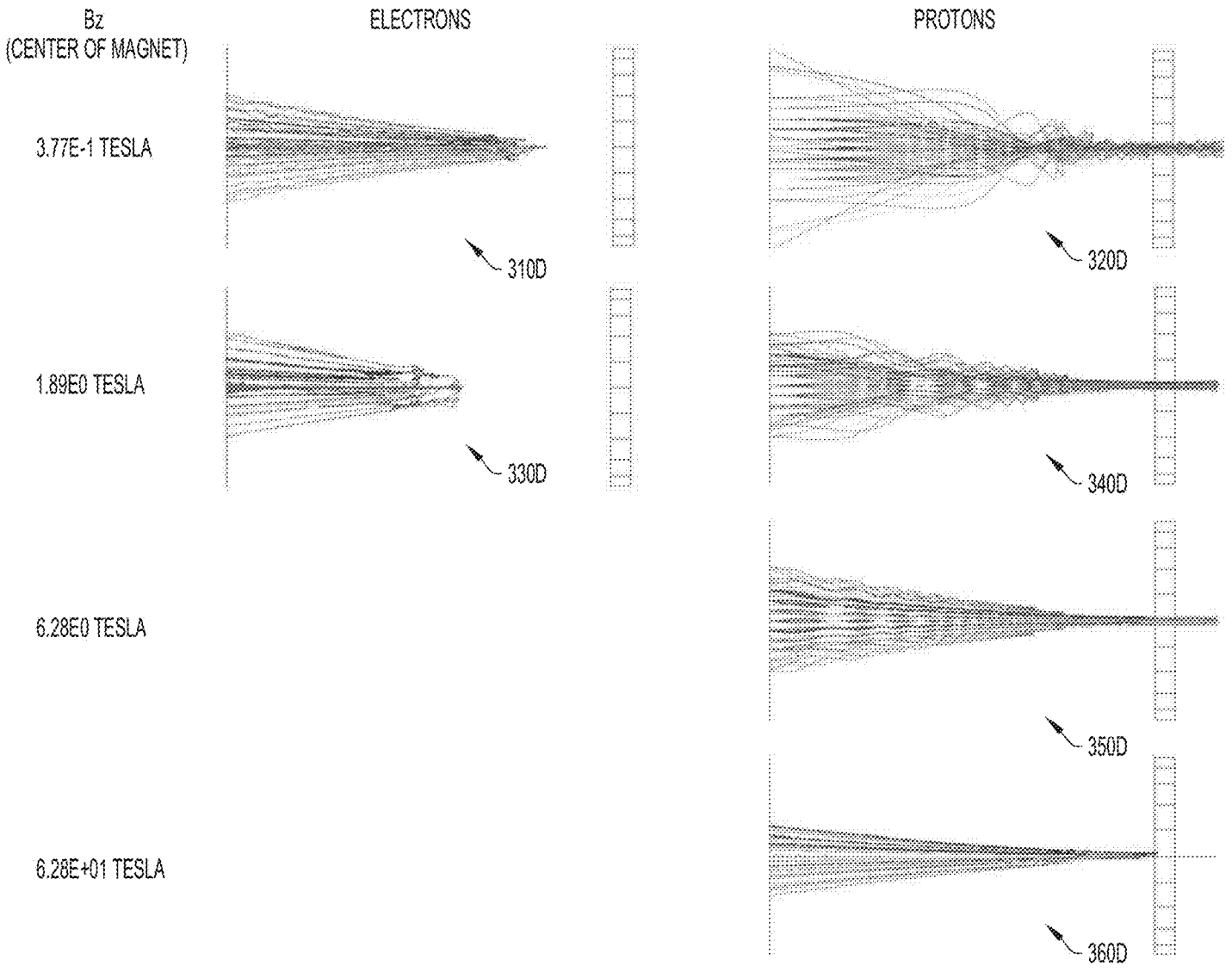

FIG. 3D illustrates further schematic diagrams 310D-360D in which the magnetic field is adjusted/varied to selectively collect only portions of the mass-charge spectrum for ions that enter the magnetic field with a velocity that is parallel to the Z-axis. In schematic diagrams 310D and 320D, the magnetic field along the Z-axis at the center of the magnet is 3.77E-1 Tesla. In schematic diagrams 330D and 340D, the magnetic field along the Z-axis at the center of the magnet is 1.89E0 Tesla. In schematic diagram 350D, the magnetic field along the Z-axis at the center of the magnet is 6.28E0 Tesla. In schematic diagram 360D, the magnetic field along the Z-axis at the center of the magnet is 6.28E1 Tesla. Schematic diagrams 310D and 330D illustrate how electrons behave under these conditions, and schematic diagrams 320D, 340D, 350D, and 360D illustrate how protons behave under these conditions.

Figure 3E:
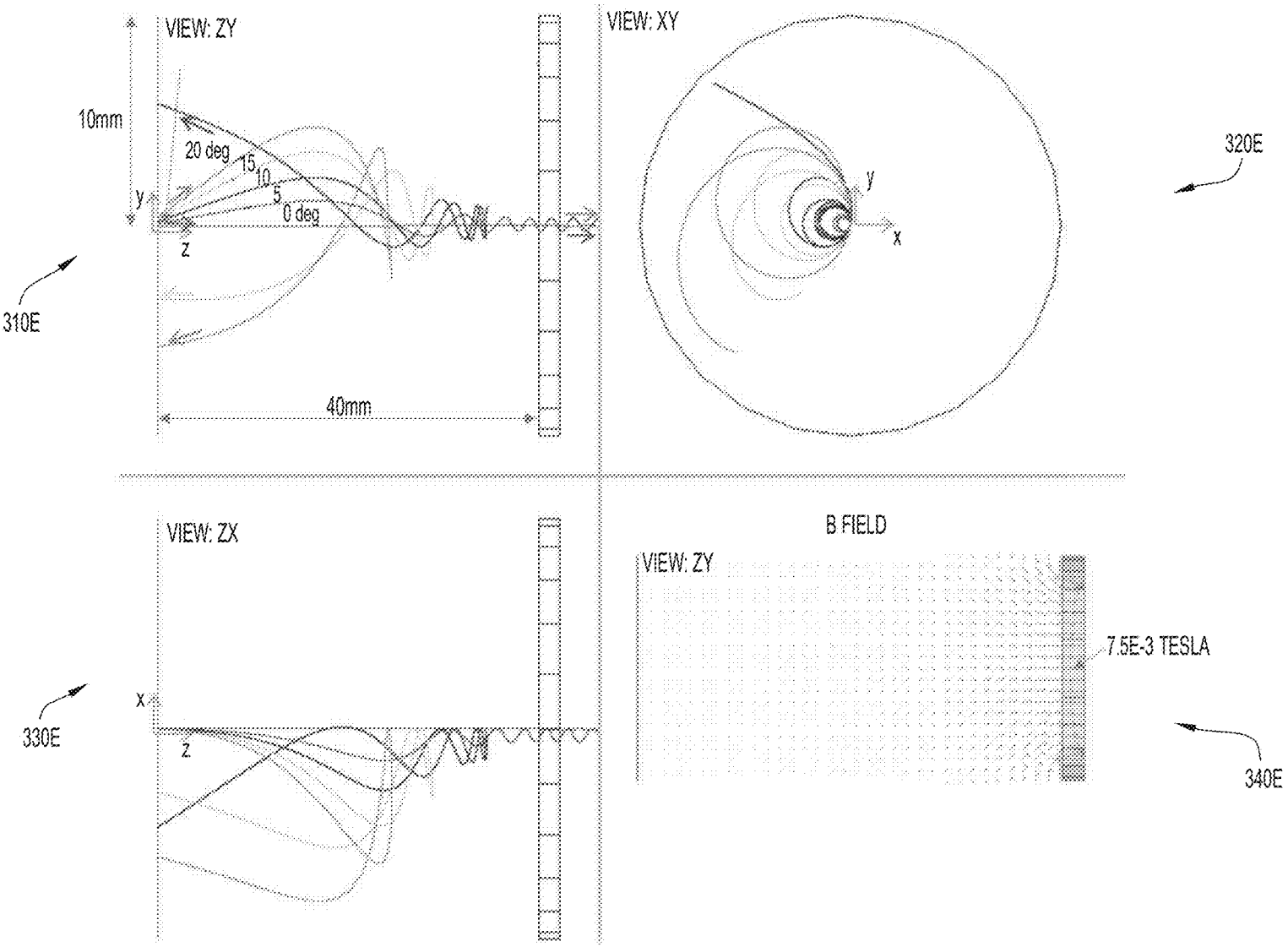

With reference to FIG. 3E, shown are three views 310E-330E of incident particles (e.g., electrons) having various angles of entry, and schematic diagram 340E which illustrates the magnetic field in the plane of view 310E. The magnetic field along the Z-axis at the center of the magnet is 7.5E-3 Tesla. Initial velocity for all electrons is 1 m/s. Electrons have angles of entry of 0 degrees, 5 degrees, 10 degrees, 15 degrees, and 20 degrees. In this example, electrons having angles of entry greater than 5 degrees are reflected back.

Figure 3F:
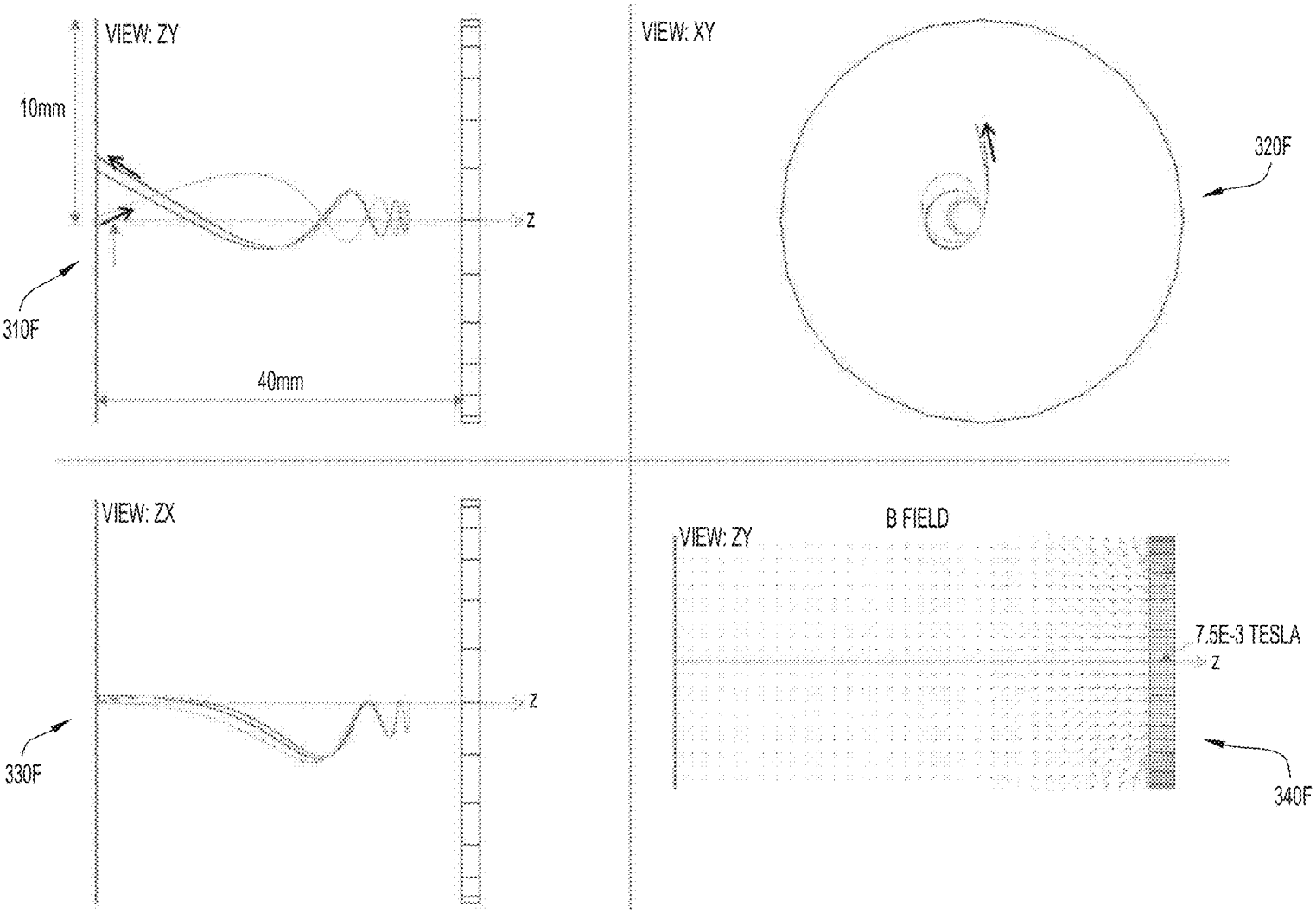

With reference to FIG. 3F, shown are three views 310F-330F of incident particles (e.g., electrons) having various initial velocities at entry, and schematic diagram 340F which illustrates the magnetic field in the plane of view 310F. The magnetic field along the Z-axis at the center of the magnet is 7.5E-3 Tesla. Initial angle of entry for all electrons is 10 degrees. Electrons have initial velocities at entry of 1E-3 m/s, 1 m/s, 1E3 m/s, and 1E6 m/s. In this example, all electrons are reflected back, and trajectory is not significantly changed by entry velocity.

Figure 3G:
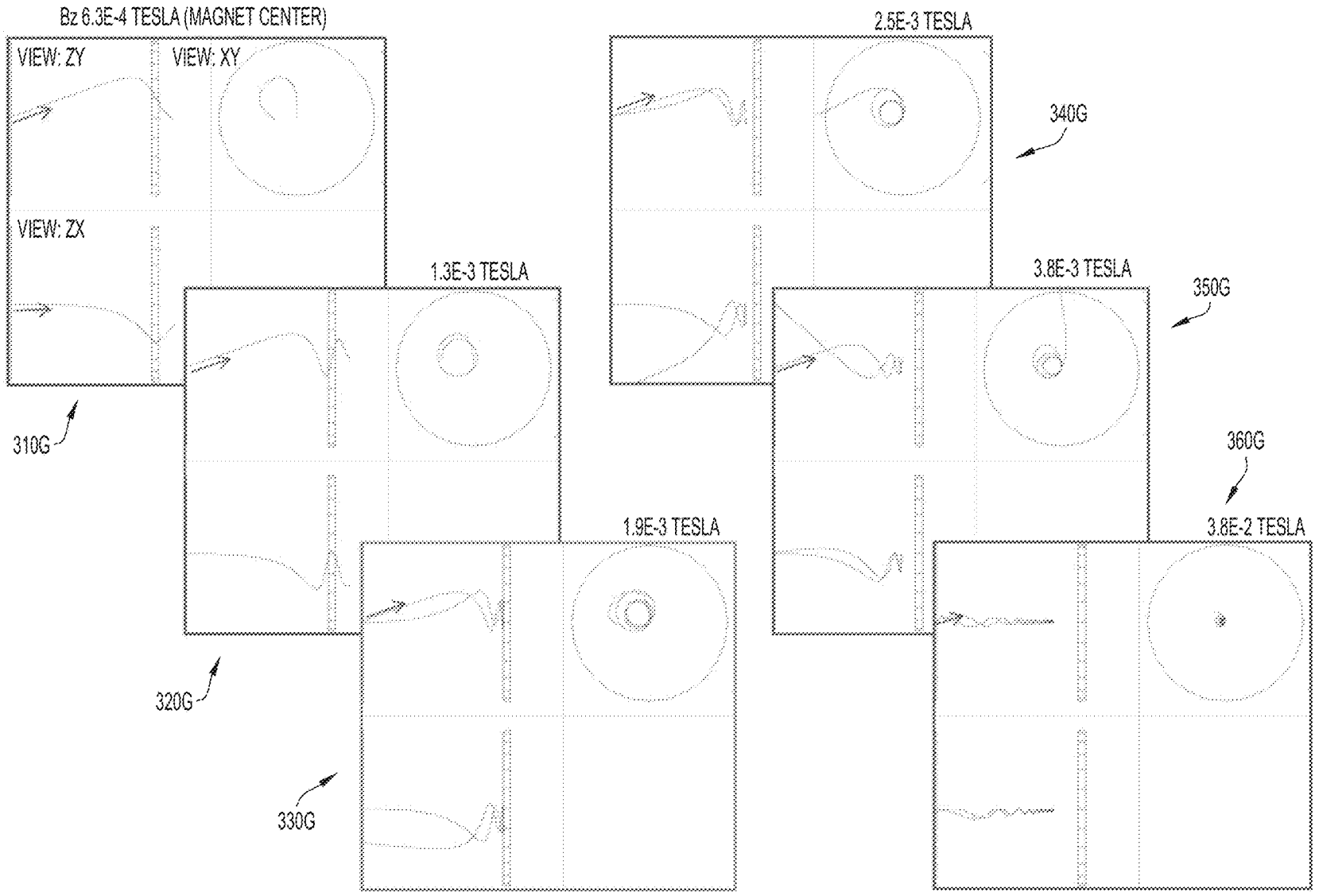

With reference to FIG. 3G, shown are six schematic illustrations 310G-360G in which the magnetic field is adjusted/varied for an incident particle (e.g., electron). Initial angle of entry for the electron is 10 degrees, and the initial velocity is 1.0 m/s. In schematic illustration 310G, the magnetic field along the Z-axis at the center of the magnet is 6.3E-4 Tesla. In schematic illustration 320G, the magnetic field along the Z-axis at the center of the magnet is 1.3E-3 Tesla. In schematic illustration 330G, the magnetic field along the Z-axis at the center of the magnet is 1.9E-3 Tesla.

In schematic illustration 340G, the magnetic field along the Z-axis at the center of the magnet is 2.5E-3 Tesla. In schematic illustration 350G, the magnetic field along the Z-axis at the center of the magnet is 3.8E-3 Tesla. In schematic illustration 360G, the magnetic field along the Z-axis at the center of the magnet is 3.8E-2 Tesla. As shown, the electron is reflected back for magnetic fields along the Z-axis at the center of the magnet greater than 1.9E-3 Tesla.

Figure 3H:
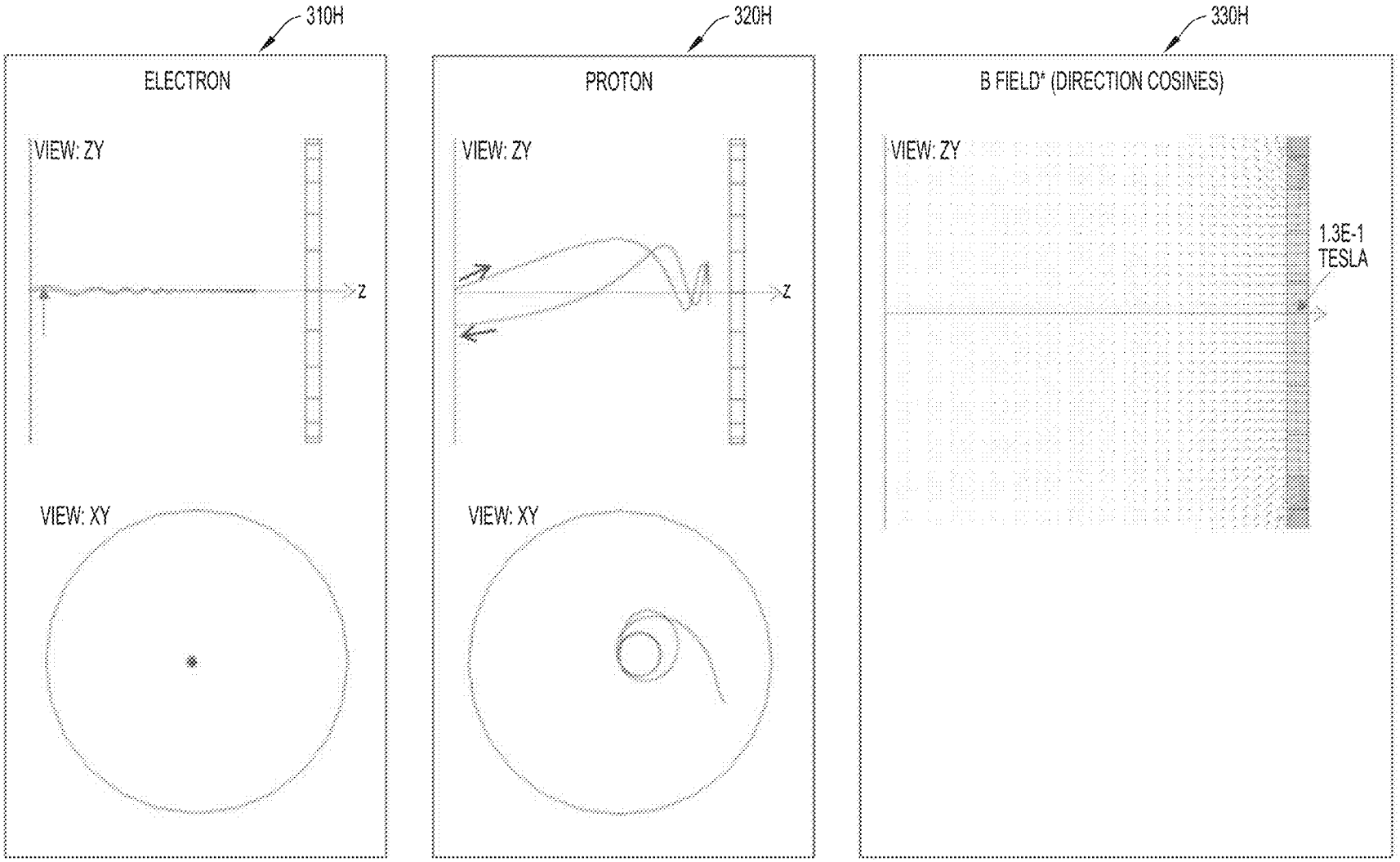

With reference to FIG. 3H, shown are three schematic diagrams 310H-330H illustrating examples for particles of varying mass and charge. In particular, schematic diagram 310H illustrates an incident electron, and schematic diagram 320H illustrates an incident proton. Both particles have an entry angle of 10 degrees and an entry velocity of 1 m/s. Schematic diagram 330H illustrates the magnetic field, which is 1.3E-1 Tesla along the Z-axis at the center of the magnet. A relatively high magnetic field is used here to discriminate particles with large mass. As shown, both the electron and the proton are reflected back.

Figure 3I:
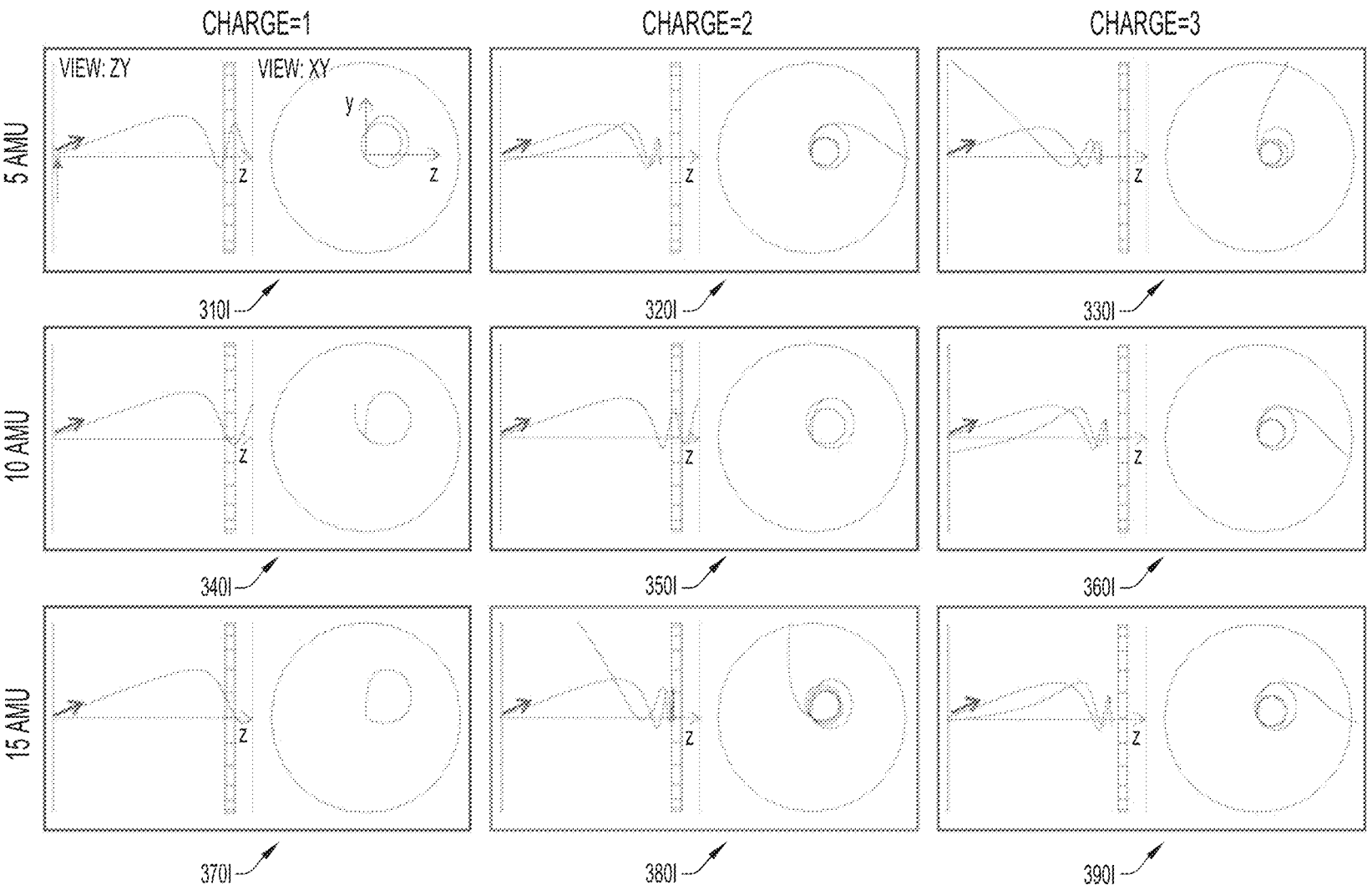

With reference to FIG. 3I, shown are nine schematic diagrams 310I-390I illustrating further examples for particles of varying mass and charge. All particles have an entry angle of 10 degrees and an entry velocity of 1 m/s. The particle in schematic diagram 310I has a mass of 5 Atomic Mass Units (AMU) and a charge of 1. The particle in schematic diagram 320I has a mass of 5 AMU and a charge of 2. The particle in schematic diagram 330I has a mass of 5 AMU and a charge of 3.

The particle in schematic diagram 340I has a mass of 10 AMU and a charge of 1. The particle in schematic diagram 350I has a mass of 10 AMU and a charge of 2. The particle in schematic diagram 360I has a mass of 10 AMU and a charge of 3. The particle in schematic diagram 370I has a mass of 15 AMU and a charge of 1. The particle in schematic diagram 380I has a mass of 15 AMU and a charge of 2. The particle in schematic diagram 390I has a mass of 15 AMU and a charge of 3. As shown, particles with higher charge and lower mass are reflected back.

Figure 3J:
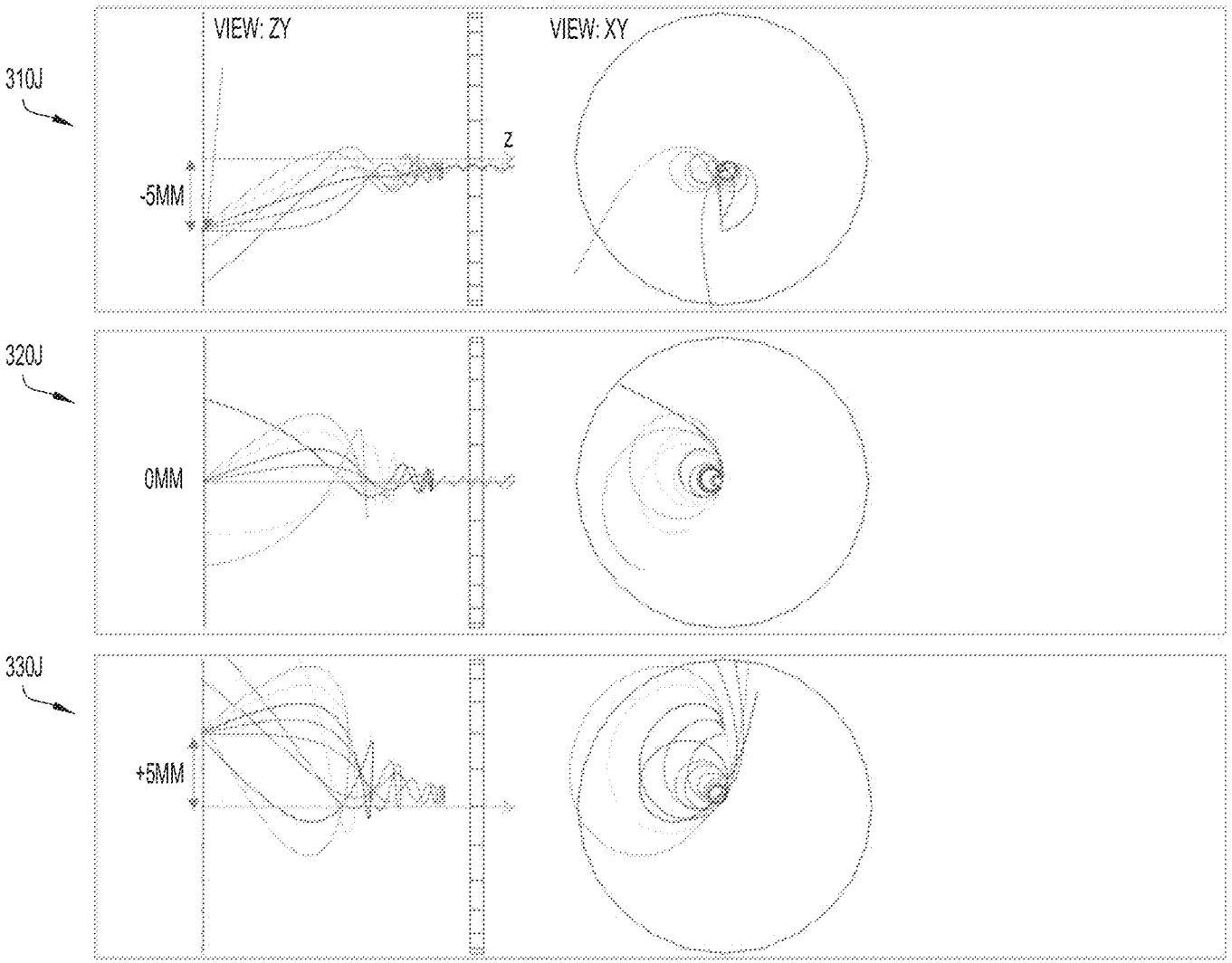

With reference to FIG. 3J, shown are three scenarios 310J-330J illustrating examples for off-Z-axis entry. Each scenario 310J-330J illustrates electrons having entry angles of 0 degrees, 5 degrees, 10 degrees, 15 degrees, and 20 degrees. All electrons have an entry velocity of 1.0 m/s. The magnetic field along the Z-axis at the center of the magnet is 7.5E-3 Tesla for all three scenarios 310J-330J. The dependence of reflection on an off-Z-axis distance may be important for planar sources.

In scenario 310J, the off-Z-axis distance is −5 mm. Here, only electrons with entry angles between 5 and 15 degrees pass through the magnet. In scenario 320J, the off-Z-axis distance is 0 mm. Here, all electrons with entry angles greater than 5 degrees are reflected back. In scenario 330J, the off-Z-axis distance is 5 mm. Here, all electrons are reflected back.

Figure 3K:
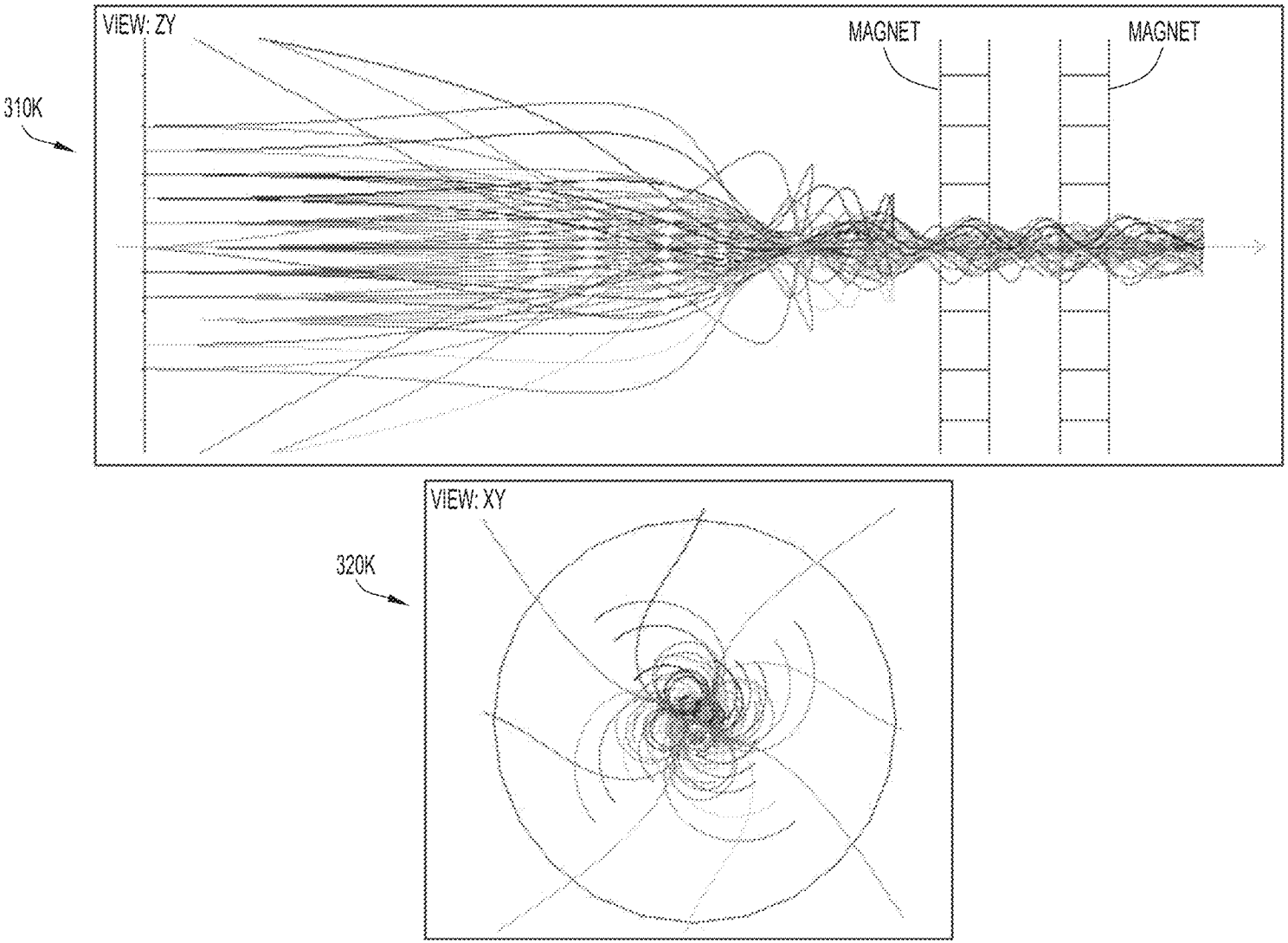

With reference to FIG. 3K, shown are two views 310K and 320K illustrating behavior of a spatial ensemble of incident particles each having an AMU of 5 and a charge of 2. As shown, the incident particles have varying off-Z-axis distances. The angles of entry of the incident particles are all zero degrees. The magnetic field along the Z-axis at the center of each of the magnets is 1.3E-1 Tesla. As shown, some particles are reflected back and some pass through the magnets. Multiple identical magnets may prevent the flux exiting the first magnet from diverging.

FIGS. 4A-4E relate to conditioner 130. Conditioner 130 may be the second stage in a space-borne-ion transport path leading to an MSOC (where collector 110 and condenser 120 are collectively the first stage). Briefly, conditioner 130 may superpose a confinement magnetic field (e.g., on the magnetic-mirror trajectory-axis field) to filter a specific population of particles out of the flux. In one example, conditioner 130 is a C-hairpin-shaped magnet configured to generate a radially-increasing (e.g., spherical) magnetic field to filter undesired ions collect. One or more such radially-increasing magnetic fields may be superposed on a beam transport magnetic field to filter out undesired parts of particle flux spectrum.

Figure 4B:
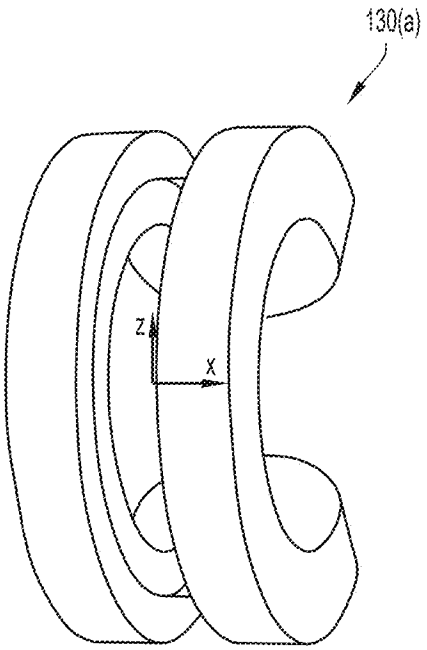
FIGS. 4A and 4B are perspective views of a conditioner configured to generate radially-increasing magnetic fields to filter undesired ions collected by the apparatus of FIG. 1, in an example embodiment.
Figure 4A:
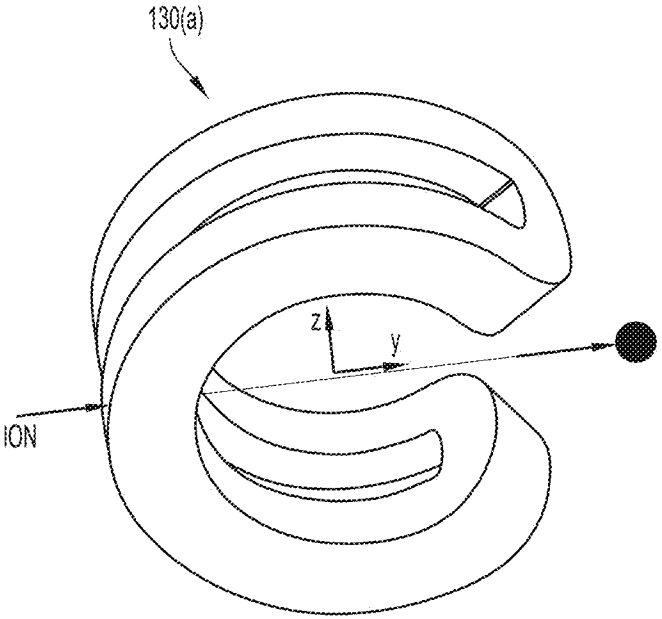

With reference to FIGS. 4A and 4B, shown are perspective views of a C-hairpin-shaped magnet 130(*a*) that may be used in conditioner 130 to generate radially-increasing magnetic fields to filter undesired ions collected by apparatus 100. In the example shown, the C-hairpin-shaped magnet 130(*a*) includes a pair of C-shaped sections parallel to one another with a small gap therebetween. Tips of the C-shaped sections are connected by cross members that extend across the small gap. FIG. 4A also illustrates the path an ion might take as it passes through the C-hairpin-shaped magnet 130(*a*). More specifically, the C-hairpin-shaped magnet 130(*a*) may be oriented so that an ion passes through the gap between the C-shaped sections of the magnet. It will be appreciated that the conditioner 130 may include a series of C-hairpin-shaped magnets, and the ion may pass through a series of such magnets.

Figure 4D:
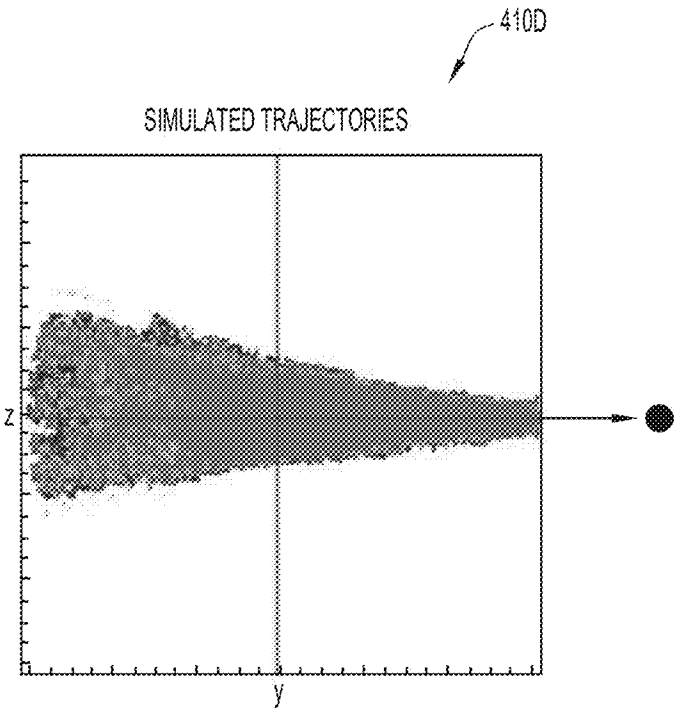
FIG. 4D is a plot illustrating simulated trajectories of particles conditioned by the conditioner of FIG. 4C, in an example embodiment.
Figure 4C:
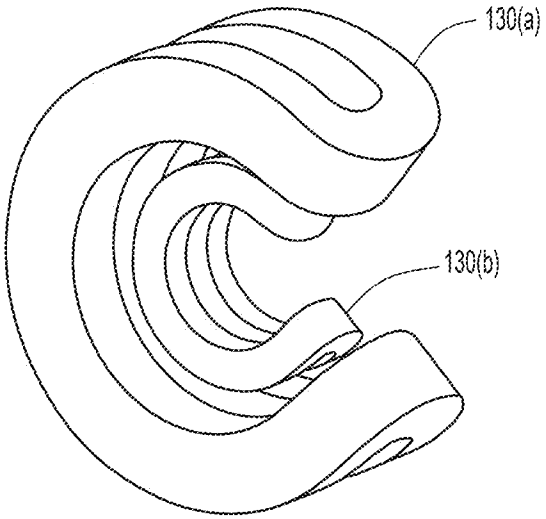
FIG. 4C is a perspective view of an alternative configuration for a conditioner configured to generate radially-increasing magnetic fields to filter undesired ions collected by the apparatus of FIG. 1, in an example embodiment.

FIG. 4C is a perspective view of nested C-hairpin-shaped magnets 130(*a*) and 130(*b*) that may be used in conditioner 130 to generate radially-increasing magnetic fields to filter undesired ions collected by the apparatus 100 of FIG. 1. In this embodiment, C-hairpin-shaped magnet 130(*b*) is sized to fit within C-hairpin-shaped magnet 130(*a*). As shown, C-hairpin-shaped magnet 130(*b*) is nested in C-hairpin-shaped magnet 130(*a*). C-hairpin-shaped magnets 130(*a*) and 130(*b*) are also parallel to one another. The nested configuration provides greater design flexibility, enabling the adjustment of both the magnitude and shape (e.g., symmetric or asymmetric) of the magnetic field. FIG. 4D is a plot 410D illustrating the effect of the nested C-hairpin-shaped magnets 130(*a*) and 130(*b*) of FIG. 4C on ions collected by apparatus 100.

Figure 4E:
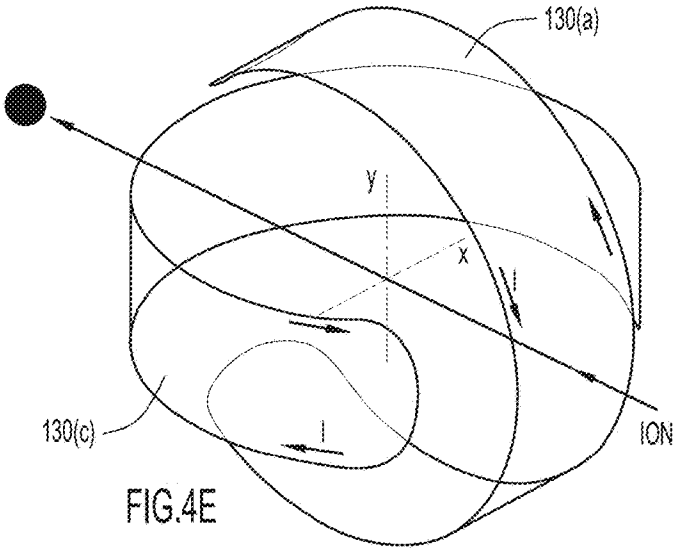
FIG. 4E is a perspective view of another alternative configuration for a conditioner configured to generate radially-increasing magnetic fields to filter undesired ions collected by the apparatus of FIG. 1, in an example embodiment.
Figure 4F:
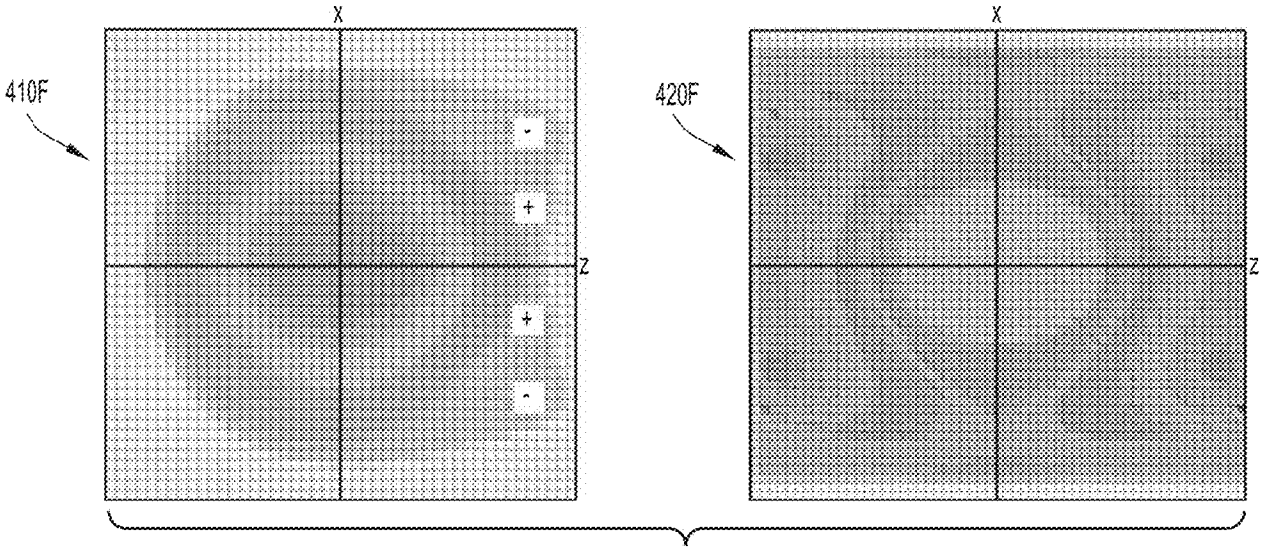
FIG. 4F illustrates respective plots of example cross-sectional isoclines generated by the conditioner of FIG. 4E, in an example embodiment.

FIG. 4E is a perspective view of interlocking C-hairpin-shaped magnets 130(*a*) and 130(*c*) that may be used in conditioner 130 to generate radially-increasing magnetic fields to filter undesired ions collected by apparatus 100. In this embodiment, hairpin-shaped magnets 130(*a*) and 130(*c*) are of the same size, but C-hairpin-shaped magnet 130(*c*) is oriented perpendicular to C-hairpin-shaped magnet 130(*c*). C-hairpin-shaped magnet 130(*c*) is arranged to fit interlockingly with C-hairpin-shaped magnet 130(*a*) (e.g., with open sides facing one another). FIG. 4E further illustrates the path an ion might take as it passes through C-hairpin-shaped magnets 130(*a*) and 130(*c*). Like the nested configuration, the interlocking configuration provides greater design flexibility, enabling the adjustment of both the magnitude and shape of the magnetic field. FIG. 4F illustrates example isoclines 410F and 420F generated by C-hairpin-shaped magnets 130(*a*) and 130(*c*) of FIG. 4E. In one example, no desirable particles drift across the outermost, highest magnetic field portions of isoclines 410F and 420F.

Any suitable structure may be used to secure C-hairpin-shaped magnets 130(*a*), 130(*b*), and/or 130(*c*), such as, for example, rigid supports including aluminum or titanium. Precision machining may eliminate the need for adjustable alignment. C-hairpin-shaped magnets 130(*a*), 130(*b*), and/or 130(*c*) and the mating support structure may be coupled together using a thin layer of adhesive/bonding glue to ensure structural stability.

Figure 5:
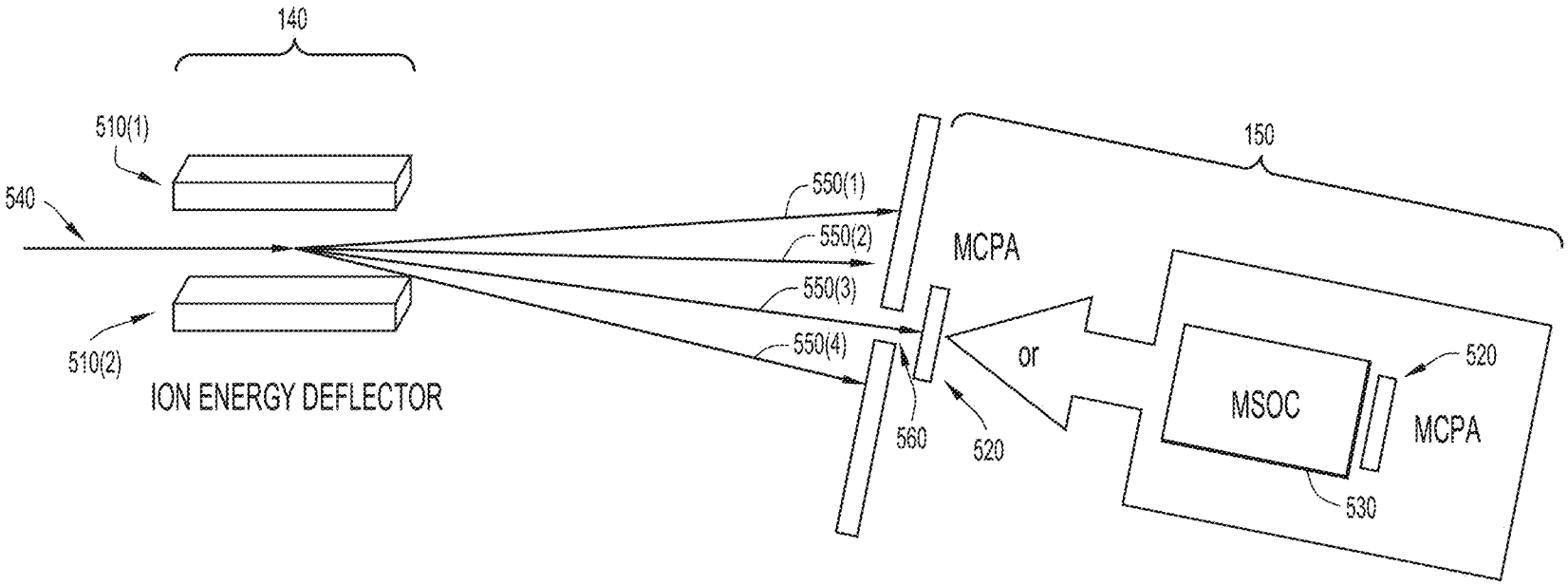
FIG. 5 is a schematic diagram illustrating ion optics and a detector of the apparatus of FIG. 1, in an example embodiment.

FIG. 5 is a schematic diagram illustrating example embodiments of ion optics 140 and detector 150 that may be used with the techniques described herein. In this example, ion optics 140 comprise an ion energy deflector including plates 510(1) and 510(2). Detector 150 includes a Multi-Channel Plate Amplifier (MCPA) 520 and/or MSOC 530. MCPA 520 may have imaging capabilities to determine a quantity of collected particles. MSOC 530 may be, for example, an electric and magnetic field MSOC.

Incoming ion beam 540 may approach ion optics 140 after exiting conditioner 130. As shown, detector 150 is displaced at an angle relative to ion optics 140. Ion optics 140 may be used to filter out (or sense) neutral particles and transport the particle (e.g., ion) sample into the MSOC for analysis. In particular, plates 510(1) and 510(2) are configured to generate an electric field (e.g., a uniform electric field) which splits the incoming ion beam 540 into split beams 550(1)-550(4).

As shown, entrance slit 560 only permits split beam 550(3) to proceed to detector 150. Thus, ion optics 140 separates collected particles (split beam 550(3)) from undesired particles (split beams 550(1), 550(2), and 550(4)). The particular split beam that proceeds to detector 150 may depend on the velocity/energy of incoming ion beam 540, magnetic field strength, angle of offset of incoming ion beam 540 to slit entrance 560, and the charge and/or mass of that particular split beam. One or more of these factors may be adjusted accordingly to detect different split beams. Detector 150 may be any suitable size/configuration (e.g., 4×4×2.5 inches), and may be selected based on its operation in a desired mass to charge ratio range.

Figure 6:
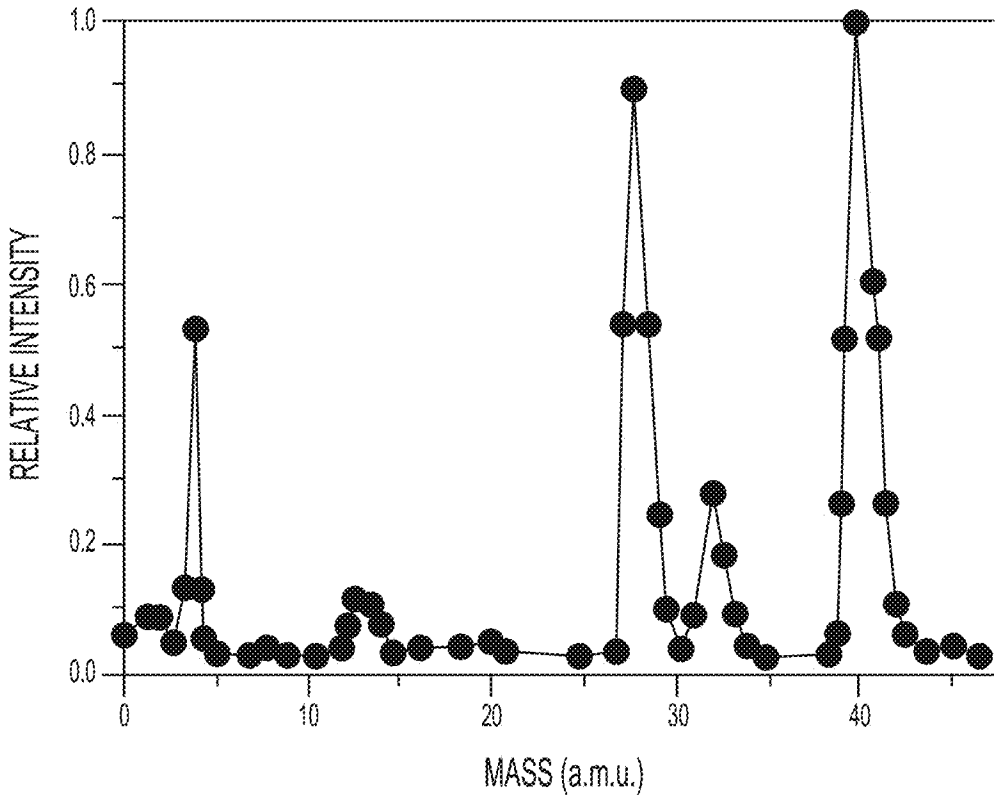
FIG. 6 illustrates a species readout from the detector of the apparatus of FIG. 1, in an example embodiment.

FIG. 6 illustrates an example species readout 600 from detector 150. The species readout plots the relative intensities of various species (e.g., ions) according to mass. Apparatus 100 (e.g., collector 110, condenser 120, conditioner 130, ion optics 140, and detector 150) may enable detecting a wide energy range of ions and outputting the detection results in the form of species readouts (e.g., species readout 600).

Figure 7:
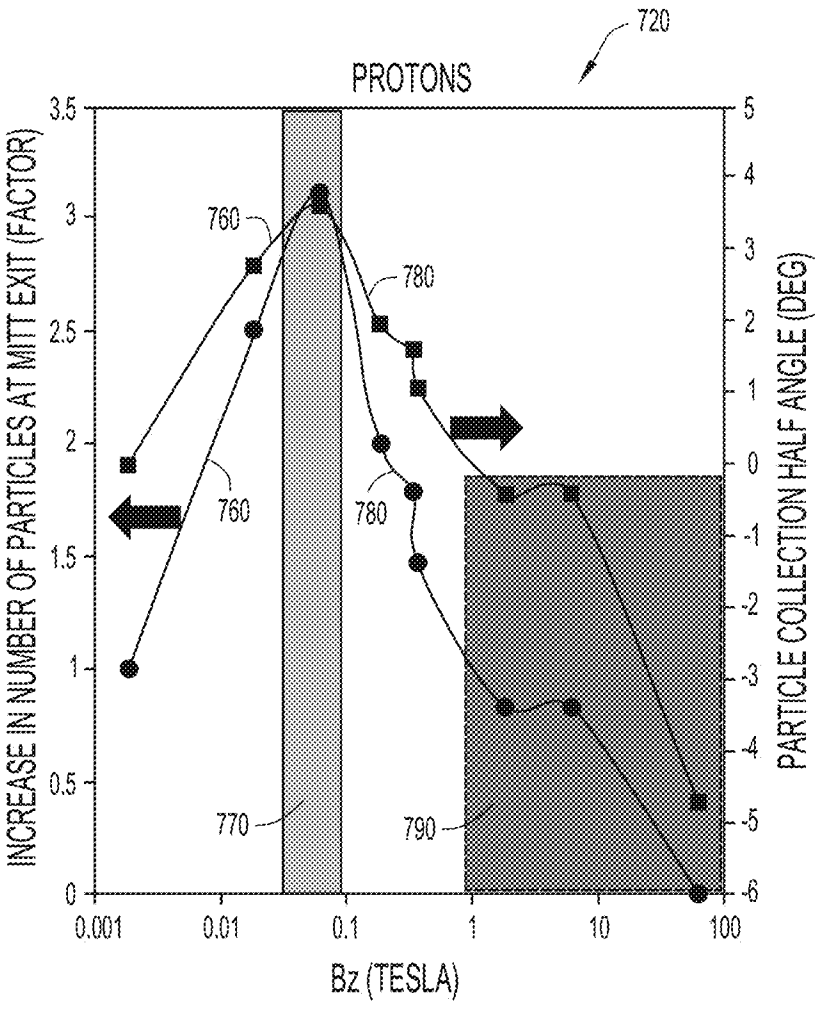
FIG. 7 illustrates plots demonstrating the effectiveness of the apparatus of FIG. 1, in an example embodiment.
Figure 7:
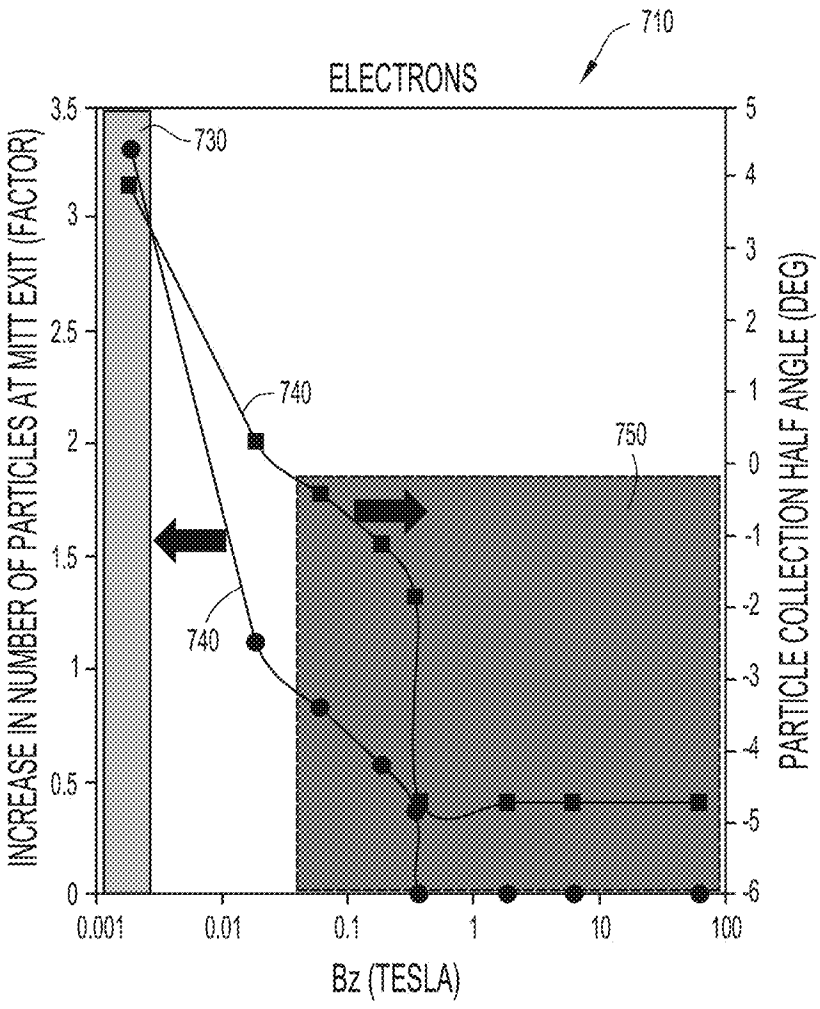

FIG. 7 illustrates plots 710 and 720 demonstrating the effectiveness of apparatus 100. Plots 710 and 720 illustrate the increase in the number of particles upon exit from the tapered magnetic ion transport tunnel and the particle collection half angle relative to the magnitude of the magnetic field along the Z-axis at the center the magnet. Plot 710 shows the behavior of electrons, and plot 720 shows the behavior of protons.

Plot 710 includes sections 730-750. Section 730 indicates a good magnetic field range to capture electrons. At section 740, the slope is affected by the number of electrons reflected back toward the source. At section 750, fewer electrons are collected with the active magnetic field. Plot 720 includes sections 760-790. At section 760, the slope is affected by the fixed size of the hole in the magnet. Section 770 indicates a good magnetic field range to capture protons. At section 780, the slope is affected by the number of protons reflected back toward the source. At section 790, fewer protons are collected with the active magnetic field.

The potentially small size of apparatus 100 allows apparatus 100 to fit on (e.g., attached to) a satellite. In one example, apparatus 100 may be calibrated using ambient atmospheric measurements. For example, the typical atmosphere near the Earth provides sufficient markers to calibrate an MSOC. As such, situational awareness may be established directly instead of from ground based sensors and optical sensors on satellites. This enables apparatus 100 to make determinations of ions and neutral chemicals relating to space weather and/or other sources. The combination of a multi-polar event along with a miniaturized mass spectrometer may permit the sensing of ion thrusters and space weather events, although any suitable detector may be used (e.g., mass spectrometer, ion energy collector, etc.).

Controlling ion energies in both the magnetic ion transport tunnel and the MSOC may allow apparatus 100 to analyze the ions. Ions may be directed by a funnel-like shape of the magnetic ion transport tunnel to be collected over a greater volume than the physical size of the entrance of the MSOC. The ions may be focused to a volume that matches the ion optic constraints of the MSOC. As a part of the MSOC, a micro-channel ion detection plate may be used to form a useful device for satellite deployment.

Apparatus 100 may accept ions with energies on the order of KeVs and direct those ions into the MSOC while controlling the energies down to the level of a few eVs. This may be accomplished by causing the apparent energy of the ions to fall into the operational regime of both the magnetic ion transport tunnel and the MSOC. This may enable the MSOC to detect and measure ions that were previously unmeasurable due to factors that limit the minimum diameter of an aperture, such as space charge (space charge may limit Amperes through a 1 mm diameter aperture (e.g., 3E2 Amperes for Cesium (atomic number 55), 3E3 Amperes for a proton (atomic number 1), etc.)) and emittance of the beam (measure of beam quality). It will be appreciated that the particular magnet configuration may be tuned/varied to selectively collect only portions of the mass-charge spectrum, depending on the given situation.

Apparatus 100 may use multi-polar magnetic fields to concentrate ions from a greater field of view and permit a miniature mass spectrometer to analyze the collected ions in space. This combination may provide useful information for science and detection awareness in a small space unit. Indeed, electromagnetic field simulations have shown apparatus 100 results in high numbers of total captures/collected particles (e.g., improvement by a factor of 2-10), efficient triage for species of interest, and strong metrics for delivery into the MSOC, as well as independent control over distribution across an efflux port.

Apparatus 100 may enable active collection of ions to greatly increase the uptake of particles, precision optimized filtering to retain only desired parts of the spectrum, and condensation of the output particle flux in a size/shape/density discharge stream compatible with MSOC operation. This enables apparatus 100 to draw in previously unreachable parts of the particle spectrum, reduce the number of particles lost through collisions with apertures, and control the output flux over a much wider range of metrics.

The use of wall-less interpenetrating magnetic fields may enable successful missions for analyzing ion properties in space. The magnetic fields may be laid out in unique configurations along the run-path to the MSOC, and perform functionally different roles to collect/triage/condense/compose the optimum output flux. Sampling statistics may rely on the additional sensitivities to resolve faithful distributions with minimal noise interference.

Apparatus 100 may provide optimally conditioned flux delivered to the MSOC. Furthermore, methods described herein may be scalable. Stages may be added for even further refinement. Apparatus 100 may handle, for example, multiplexed ion beams and particles traveling at relativistic speeds. This allows passive collection of particles outside a satellite and independent characterization of particle mass and charge, all in a small, lightweight size suitable for deployment on a satellite.

In one example, a magnetic field environment is produced outside a satellite to gather and process samples of particles in space (e.g., performing mass spectroscopy on ions from ion thrusters generated from solar activity). A non-contact magnetic funnel is described in order to guide incoming charged particles to the inlet of the mass spec at higher concentrations. The magnetic field may tune the size/mass/trajectory/energy of pass-through particle flux, and deliver a beam of particles within the momentum window that can be analyzed by an MSOC. The magnetic field may also allow the beam to fit through apertures on route to the MSOC with sufficient emittance.

Ions may be collected with a larger yield than would normally enter the orifice of a mass spectrometry system. A staged magnet system may be used to create field-induced forces on the ions and resulting trajectories. Once the magnetic funnel has been established for a range of incoming ion energies, these results may be used to design the optimum interface between the magnetically-altered ion trajectories to the floating ion-optics apparatus that prepares the ion beam for MSOC analysis. Thus, apparatus 100 enables performing mass spectrometry in space using a noncontact magnetic funnel and floating ion optic apparatus.

Noncontact ion concentration and collection methods are presented whereby space-based mass spectrometry is effective at identifying chemical species of externally generated ions. For example, apparatus 100 may collect ranges of species between 40-500 AMU with a resolution of 1 AMU at 300 AMU. This greatly expands situational awareness in space through accurate identification of chemical species, and provides intelligence on the source of chemical species coming towards national space assets. As such, ionic species from solar wind, solar mass ejection, and other sources are detectable with a passive magnetic field concentrating ions into the entrance slit of a miniature mass spectrometer which may be deployable with other instruments on a satellite.

Mass spectroscopy may be performed in space on externally created ions (e.g., due to solar wind) using a noncontact magnetic field ion funnel and ion optic transport and measurement. The noncontact magnetic field ion funnel may be collinear with the ion optic transport and measurement (and in turn with the MSOC). The noncontact magnetic field ion funnel may use static magnetic fields created by a set of staged permanent magnets to induce an appropriate force field that concentrates incoming ions (e.g., by at least a factor of two) to a mass spectrometer inlet thereby acting as an ionic funnel. The ion optic transport and measurement measures ion energy and provides separation for ions of different masses that have the same velocity, as well as for ions having different energies. This may also eliminate fast neutrals from the ion analysis path.

Apparatus 100 may effectively identify chemical species of incoming externally generated ions using a magnetic funnel, an ion optic transport, and a mass spectrometer readout. The use of a compact MSOC device in space may provide the ability to both identify foreign uncooperative nearby satellites as well as space weather which results in enhanced space situational awareness. The magnetic funnel may concentrate ions to the inlet of a mass spectrometer by at least a factor of two. The ion optic transport capability may condition the ions for mass spectrometer readout.

This added capability to study the sun (heliophysics) and other phenomena (such as ejections of nearby ion thrusters) may be made available for enhanced in-situ situational awareness. Such technology may enable detection, identification, and quantification of chemical species near national (or other) assets in space. A neutrals detection capability may be included to provide an all-inclusive chemical sensor in space using, e.g., a solid-state electron emitter in the mass spectrometer to maintain low power requirements. This enables effectively collecting more species than would otherwise without the magnetic funnel. In particular, magnetic fields may be used to collect and concentrate charged ions to the mass spectrometer sensor.

To improve knowledge of the conditions faced by satellites in orbit, electric and/or magnetic fields may be used to jointly monitor space weather and other chemically based phenomena encountered by satellites in orbit. Apparatus 100 provide several capabilities that terrestrially-based mass spectrometry systems cannot provide. One capability is clear determination of ion energies within apparatus 100 due to varying exterior satellite charging (in sampling ions generated outside of a satellite, the apparent energy value varies primarily with the charging of the outside of the satellite hosting the mass spectrometer). Another capability is the field of view collection and concentration of ions. Yet another capability is proper interaction of the electric and magnetic fields in view of space weather conditions. Still another capability is the proper interaction of the electric and magnetic fields between the ion collector and mass spectrometer. The system is sufficiently small and low power for use on satellites.

Provided on the front-end of the mass spectrometer is a magnetic funnel and an ion optic transport/measurement. Further provided is a mass ion sensor for heliophysics and other ion source detection. The compactness (e.g., less than 100 $cm^3$), low power (e.g., less than 10 W) and low mass (e.g., on the order of kg) may provide a unique capability to concentrate ions, determine ion energy/velocity and measure the mass to charge ratio of the ions in space in order to determine chemical composition can be determined. The MSOC may be Micro-Electro-Mechanical Systems (MEMS)-based, and may be fitted with a micro-channel plate detector for greater sensitivity.

Since the magnetic field optimum for ion concentration can reverse direction of ions back out, it may be desirable to modify the layout and number of magnets (e.g., with multiple stages instead of just a single stage) and vary the polarity with azimuthal angle for more degrees of freedom. In addition, to prevent magnetic fields from impacting MSOC or ion transport operability, the resulting magnetic field output of the magnetic funnel may be observed to determine any degradation in behavior. If such degradation is observed, the placement physical degrees of freedom available may be tuned to arrive at a new optimum through the use of genetic algorithms.

Satellite surface charging can vary widely. For example, solar wind values of charging can range from −18 to −260 V for orbits from 5.2 AU to 0.3 Astronomical Units. Higher charging occurs when closer to the sun. Geo-orbits around Earth can have potentials between −500 to −23000 V, depending on solar storms. A floating voltage may be used to control the ion energy in the MSOC to maintain optimum conditions, even when satellite surface charging varies. Voltage floating requirements may be determined to resolve heavy and light mass-to-charge ratio ions.

An input (e.g., electrostatic) deflector may also be used to measure ion beam energy (e.g., an ion brake). The electrostatic deflector may include instruments with electrometer measurements so that if multiple ion beams energies exist, each may be transmitted separately through the MSOC. The MSOC device may be floated to handle the range of ion energies for neutral and space weather ion species. The MSOC may be a crossed electrostatic and magnetic field, and the ions are fanned out in the direction of the electrostatic field by their velocities due to this geometry. Fast neutrals and ions may be slowed down in order to control the effective ion energy in the crossed electric and magnetic fields. The configuration of apparatus 100 may be adjusted for the angular capture of ion beams. A typical ion angle input into a mass spectrometer allows for only one or two degrees in width.

Collector 110, condenser 120, and/or conditioner 130 may be used with various types of ion optics and/or detectors, including without limitation the ion analyzer (or one or more aspects thereof) described in co-pending U.S. application Ser. No. 15/718,020, filed on Sep. 28, 2017, the disclosure of which is incorporated by reference herein in its entirety.

A mass to charge ratio spectrum may be produced and associated with particular chemicals that enter the mass spectrometer. For detection of ions formed in a space environment, the effective ion energy of the ions may be quantified. This may impact the operating conditions within the system so that the same mass to charge ratio data (and therefore potential chemical compositions) may be derived. This may also contribute to the exit slit parameters for the ion transport. Ion masses may extend to larger mass ranges due to a number of factors. Higher ion beam energies may allow the higher resolution of high charge to mass ratios, at the expense of lighter mass to charge ratios being spread out.

In one form, an apparatus for particle collection is provided. The apparatus comprises: a magnetic element configured to generate a tapered magnetic ion transport tunnel that collects particles from a local environment; a detector configured to perform one or more measurements of the collected particles; and ion optics configured to transport the collected particles to the detector. The ion optics may include two plates configured to generate an electric field that separates the collected particles from undesired particles based at least in part on respective charges and masses of the collected particles. The detector may include a mass spectrometer on a chip. The local environment may be a volume of space local to a satellite to which the apparatus is affixed.

In one example, the magnetic element includes a multipole magnet. The multipole magnet may be disk-shaped and/or a quadrupole magnet. Furthermore, the multipole magnet may be one multipole magnet in a series of multipole magnets, and wherein each multipole magnet in the series of multipole magnets is azimuthally rotated relative to an adjacent disk-shaped multipole magnet. In a first example, each multipole magnet in the series of multipole magnets defines a hole through which the collected particles proceed, wherein a diameter of the hole is greater than a diameter of the hole of a subsequent (i.e., downstream) multipole magnet in the series of multipole magnets. In a second example, each multipole magnet in the series of multipole magnets defines a hole through which the collected particles proceed, wherein the holes are of equal diameter.

In another example, another magnetic element is configured to generate a radially-increasing magnetic field to filter the collected particles from undesired particles. The other magnetic element may be a C-hairpin-shaped magnet. In a first example, the C-hairpin-shaped magnet is nested in another C-hairpin-shaped magnet. In a second example, the C-hairpin-shaped magnet is configured interlockingly with another C-hairpin-shaped magnet.

One or more features disclosed herein may be implemented in, without limitation, circuitry, a machine, a computer system, a processor and memory, a computer program encoded within a computer-readable medium, and/or combinations thereof. Circuitry may include discrete and/or integrated circuitry, application specific integrated circuitry (ASIC), field programmable gate array (FPGA), a system-on-a-chip (SOC), and combinations thereof.

Methods and systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed. While various embodiments are disclosed herein, it should be understood that they are presented as examples. The scope of the claims should not be limited by any of the example embodiments disclosed herein.

What has been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. An apparatus for particle collection, comprising:

a first magnetic element configured to generate a tapered magnetic ion transport tunnel that collects particles from a local environment;

a second magnetic element comprising a C-hairpin-shaped magnet and configured to generate a radially-increasing magnetic field to filter the collected particles from undesired particles;

a detector configured to perform one or more measurements of the collected particles; and ion optics configured to transport the collected particles to the detector.

2. The apparatus of claim 1, wherein the C-hairpin-shaped magnet is nested in another C-hairpin-shaped magnet.

3. The apparatus of claim 1, wherein the C-hairpin-shaped magnet is configured interlockingly with another C-hairpin-shaped magnet.

4. An apparatus for particle collection, comprising:

a magnetic element configured to generate a tapered magnetic ion transport tunnel that collects particles from a local environment;

a C-hairpin-shaped magnet configured to generate a radially-increasing magnetic field to filter the collected particles from undesired particles; and a detector configured to perform one or more measurements of the collected particles.

5. The apparatus of claim 4, wherein the C-hairpin-shaped magnet is nested in another C-hairpin-shaped magnet.

6. The apparatus of claim 4, wherein the C-hairpin-shaped magnet is configured interlockingly with another C-hairpin-shaped magnet.

* * * * *